US009809917B2

(12) United States Patent
Hong et al.

(10) Patent No.: US 9,809,917 B2
(45) **Date of Patent: *Nov. 7, 2017**

(54) APPARATUS FOR TREATING LAUNDRY

(71) Applicants: Sogkie Hong, Seoul (KR); Jongseok Kim, Seoul (KR); Sungmin Kim, Seoul (KR); Daeyun Park, Seoul (KR); Sungryong Kim, Seoul (KR)

(72) Inventors: Sogkie Hong, Seoul (KR); Jongseok Kim, Seoul (KR); Sungmin Kim, Seoul (KR); Daeyun Park, Seoul (KR); Sungryong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 737 days.

This patent is subject to a terminal disclaimer.

(21) Appl. No.: 14/179,261

(22) Filed: Feb. 12, 2014

(65) Prior Publication Data

US 2014/0202217 A1 Jul. 24, 2014

Related U.S. Application Data

(63) Continuation of application No. 13/205,378, filed on Aug. 8, 2011, now Pat. No. 9,096,965.

(30) Foreign Application Priority Data

Aug. 9, 2010 (KR) ..... 10-2010-0076597
Aug. 9, 2010 (KR) ..... 10-2010-0076598
(Continued)

(51) Int. Cl.
*D06F 58/06* (2006.01)
*D06F 58/08* (2006.01)
(Continued)

(52) U.S. Cl.
CPC ..... *D06F 37/04* (2013.01); *D06F 37/02* (2013.01); *D06F 37/30* (2013.01); *D06F 58/06* (2013.01); *D06F 58/08* (2013.01)

(58) Field of Classification Search
CPC ..... D06F 58/06; D06F 58/08; D06F 37/02; D06F 37/30
See application file for complete search history.

(56) References Cited

U.S. PATENT DOCUMENTS 2,062,030 A 11/1936 Johnson
3,402,477 A 9/1968 Hubbard
(Continued)

FOREIGN PATENT DOCUMENTS

DE 10 2007 046068 4/2008
EP 0 112 138 A1 6/1984
(Continued)

OTHER PUBLICATIONS

Korean Office Action dated Jun. 7, 2016 issued in Application No. 10-2010-0076597.
(Continued)

*Primary Examiner* — Michael Barr
*Assistant Examiner* — Irina Graf
(74) *Attorney, Agent, or Firm* — KED & Associates, LLP

(57) ABSTRACT

Provided is a laundry treating apparatus including a drum, a circular guide, and a panel. The drum holds laundry, has a front side and a rear side opened, and has a cross-section of a noncircular looped curve in which a distance from a rotation center is not uniform. The circular guide rotatably supports a portion of the drum in which a section curvature is uniform. The panel is provided on a front side or a rear side of the drum and supports the circular guide such that the circular guide is rotatable.

19 Claims, 37 Drawing Sheets

(30) Foreign Application Priority Data

| | | |
|---|---|---|
| Aug. 9, 2010 | (KR) | 10-2010-0076599 |
| Nov. 10, 2010 | (KR) | 10-2010-0111621 |
| Nov. 10, 2010 | (KR) | 10-2010-0111622 |
| Nov. 10, 2010 | (KR) | 10-2010-0111623 |
| Nov. 10, 2010 | (KR) | 10-2010-0111624 |
| Nov. 29, 2010 | (KR) | 10-2010-0119717 |
| Nov. 29, 2010 | (KR) | 10-2010-0119718 |

(51) Int. Cl.

| | |
|---|---|
| ***D06F 37/04*** | (2006.01) |
| ***D06F 37/02*** | (2006.01) |
| ***D06F 37/30*** | (2006.01) |

(56) References Cited

U.S. PATENT DOCUMENTS

| | | | | |
|---|---|---|---|---|
| 4,007,546 | A | 2/1977 | Sauer | 34/133 |
| 4,109,493 | A | 8/1978 | Hugenbruch | |
| 4,430,809 | A * | 2/1984 | Jackson | D06F 58/06 34/601 |
| 4,510,697 | A | 4/1985 | Beasley et al. | |
| 4,621,438 | A | 11/1986 | Lanciaux | 34/77 |
| 6,516,638 | B1 | 2/2003 | Myerscough | 68/23.1 |
| 6,874,248 | B2 | 4/2005 | Hong et al. | 34/239 |
| 8,528,231 | B2 | 9/2013 | Kim et al. | |
| 9,096,965 | B2 * | 8/2015 | Hong | D06F 37/02 |
| 9,382,656 | B2 * | 7/2016 | Lee | F26B 21/003 |
| 9,428,856 | B2 * | 8/2016 | Lee | F26B 21/003 |
| 9,540,757 | B2 * | 1/2017 | Lee | F26B 21/003 |
| 2008/0184585 | A1 | 8/2008 | Yoo et al. | |
| 2009/0158617 | A1 | 6/2009 | Ricklefs et al. | 34/603 |

FOREIGN PATENT DOCUMENTS

| | | |
|---|---|---|
| EP | 0 903 433 | 3/1999 |
| JP | S52-138465 U | 10/1977 |
| JP | 59-141999 U | 9/1984 |
| JP | S59-225100 A | 12/1984 |
| JP | S60-036897 U | 3/1985 |
| JP | H03-062587 Y2 | 6/1991 |
| JP | H08-318097 | 12/1996 |
| JP | H09-206500 | 8/1997 |
| JP | 2007-117278 | 5/2007 |
| KR | 10-1999-0033910 | 5/1999 |
| KR | 10-2004-0006235 | 1/2004 |
| KR | 10-2005-0108117 | 11/2005 |
| KR | 10-2005-0109373 | 11/2005 |
| KR | 10-2006-0010365 | 2/2006 |
| KR | 10-2006-0127370 | 12/2006 |
| KR | 10-0680623 | 2/2007 |
| KR | 10-2005-0108117 | 11/2015 |
| WO | WO 98/48095 | 10/1998 |
| WO | WO 02/086218 | 10/2002 |
| WO | WO 2006/120644 A1 | 11/2006 |
| WO | WO 2011/105829 | 9/2011 |

OTHER PUBLICATIONS

Korean Office Action dated Jun. 7, 2016 issued in Application No. 10-2010-0076598.

Korean Office Acton dated Aug. 8, 2016 issued in Application No. 10-2010-0111622.

Korean Office Acton dated Aug. 8, 2016 issued in Application No. 10-2010-0111623.

Korean Office Acton dated Sep. 2, 2016 issued in Application No. 10-2010-0119717.

Japanese Office Action dated Feb. 18, 2014 issued in Application No. 2013-524035.

U.S. Office Action dated Sep. 22, 2014 issued in U.S. Appl. No. 13/205,378.

Chinese Office Action dated Dec. 25, 2014 issued in Application No. 201180048917.3 (Full Chinese Text and Full English translation).

European Office Action dated Mar. 11, 2016 issued in Application No. 11816585.1.

U.S. Notice of Allowance dated Match 16, 2015 issued in U.S. Appl. No. 13/205,378.

International Search Report dated Jul. 6, 2012 for Application PCT/KR2011/005797.

European Search Report issued in EP Appln. No. 11816585.1 dated Apr. 29, 2013.

European Search Report issued in EP Appln. No. 13156866.9 dated Apr. 29, 2013.

European Search Report issued in EP Appln. No. 13156868.5 dated Apr. 29, 2013.

U.S. Office Action dated Feb. 10, 2017 issued in U.S. Appl. No. 14/179,296.

* cited by examiner

APPARATUS FOR TREATING LAUNDRY

CROSS-REFERENCE TO RELATED APPLICATION(S)

This application is a Continuation of application Ser. No. 13/205,378 filed on Aug. 8, 2011, which claims priority from Korean Patent Application No. 10-2010-0076597 filed Aug. 9, 2010, No. 10-2010-0076598 filed Aug. 9, 2010, No. 10-2010-0076599 filed Aug. 9, 2010, No. 10-2010-0111621 filed Nov. 10, 2010, No. 10-2010-0111622 filed Nov. 10, 2010, No. 10-2010-0111624 filed Nov. 10, 2010, No. 10-2010-0111623 filed Nov. 10, 2010, No. 10-2010-0119718 filed Nov. 29, 2010, and No. 10-2010-0119717 filed Nov. 29, 2010 in the Korean Intellectual Property Office, the disclosure of which is incorporated herein by reference in its entirety.

BACKGROUND

1. Field

The present invention relates to an apparatus for treating laundry, and more particularly, to an apparatus for treating laundry, in which a space for holding laundry can be secured to the maximum.

2. Background

Laundry treating apparatuses refer to apparatuses that are used at home or cleaner's for management or treatment of clothing and bedding (hereinafter, referred to as laundry) such as washing, drying, and smoothing of laundry. Examples of laundry treating apparatuses include washing machines that remove contaminants from laundry using chemical disintegration of water and detergent and physical action such as friction between water and laundry, a dryer that dries wet laundry, and refresher that prevents allergy caused by laundry and allows laundry to be conveniently washed, by spraying heated vapor to laundry.

Dryers are home appliances that dry washed laundry using hot air. Generally, dryers have a drum that holds laundry and rotates. Hot dry air is supplied into the drum that holds laundry and rotates, and humid air is exhausted out of the drum. In this case, since the drum of the dryer is formed to be rotatable, it is difficult to secure a space for holding laundry to the maximum.

BRIEF DESCRIPTION OF THE DRAWINGS

The embodiments will be described in detail with reference to the following drawings in which like reference numerals refer to like elements wherein.

DETAILED DESCRIPTION

Figure 1:
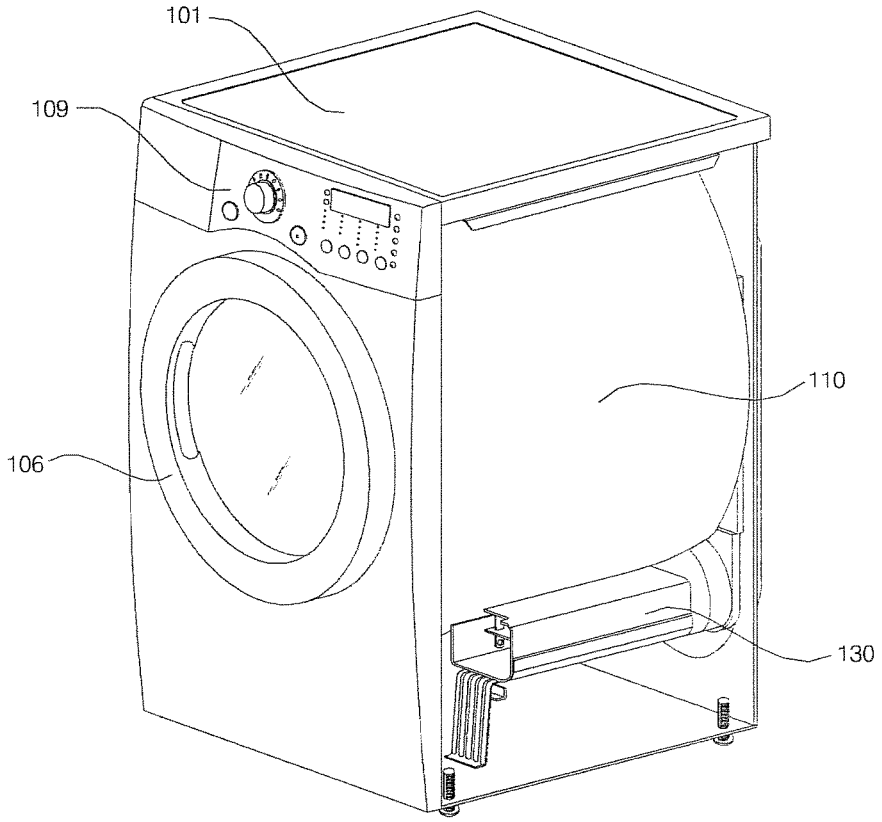
FIG. 1 is a perspective view illustrating a laundry treating apparatus according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, a laundry treating apparatus according to embodiments of the present invention will be described in detail with reference to the accompanying drawings.

Figure 2:
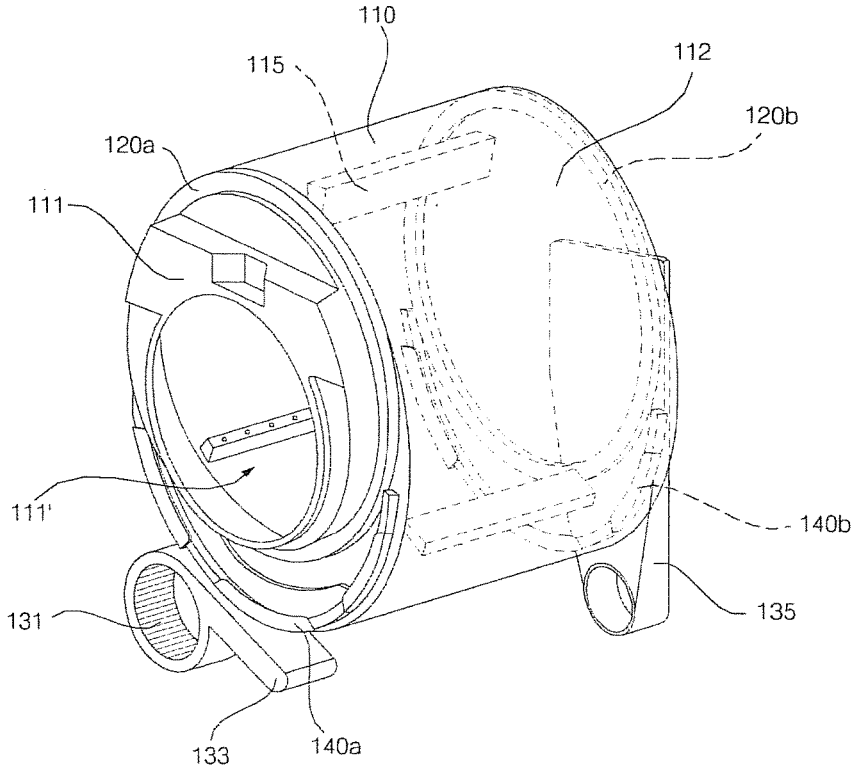
FIG. 2 is a perspective view illustrating the inside of a laundry treating apparatus according to an embodiment of the present invention.

FIG. 1 is a perspective view illustrating a laundry treating apparatus according to an embodiment of the present invention. FIG. 2 is a perspective view illustrating the inside of a laundry treating apparatus according to an embodiment of the present invention.

The laundry treating apparatus may include a cabinet 101 defining the exterior, a drum 110 rotatably disposed in the cabinet 101 to hold laundry, circular guides 120*a* and 120*b* that is rotatably disposed and supports a portion where the cross-sectional curvature of the drum 110 is uniform, a front panel 111 and a rear panel 112 supporting the circular guides 120*a* and 120*b* and disposed at the front surface and the rear surface of the drum 110, respectively, and auxiliary guides 140*a* and 140*b* supporting a portion that is not supported by the circular guides 120*a* and 120*b*.

The cabinet 101 may define the exterior of the laundry treating apparatus. A cabinet loading hole for loading laundry into the drum 110 may be disposed on the front surface of the cabinet 101, and a door 106 for opening and closing the cabinet loading hole may be rotatably connected to the cabinet loading hole. Also, a control panel 109 may be provided on the front surface of the cabinet 101 to receive operation commands from a user and display the operation state of the laundry treating apparatus.

A front panel 111 may be disposed at the rear of the front surface of the cabinet 101 to support the front circular guide 120*a*. The front circular guide 120*a* and the front auxiliary guide 140*a* may be disposed on the front panel 111 to maintain the shape of the drum 110.

The front panel 111 may support the front circular guide 120*a* such that the front circular guide 120*a* can rotate. The front panel 111 may be coupled to the cabinet 101, and support the front circular guide 120*a* that supports the load of the drum 110. The front panel 111 may have a panel loading hole 111' for loading laundry into the drum 110, in alignment with the cabinet loading hole of the cabinet 101. The panel loading hole 111' may be opened and closed by the door 106.

The front panel 111 may include an air blower 131 for exhausting air from the drum 110, and an exhaust duct 133 for passing air blown by the air blower 131. The front panel 111 may include an exhaust hole that communicates with the exhaust duct 133 to exhaust air from the drum 110. The front panel 111 may contact with the drum 110 at the front side of the drum 110 to seal the front side of the drum 110 such that air does not leak from the drum 110 but is exhausted to the exhaust duct 133.

A lint filter (not shown) may be provided on the front panel 111 to filter foreign substances from air exhausted by the air blower 131. Air having passing the exhaust duct 133 may be exhausted to the outside of the cabinet 101, or may flow into a heater 130.

A rear panel 112 may be disposed at the front of the rear surface of the cabinet to support the rear circular guide 120*b*. The rear panel 112 may include the rear circular guide 120*b* and the rear auxiliary guide 140*b* for maintaining the shape of the drum 110.

The rear panel 112 may support the rear circular guide 120*b* such that the rear circular guide 120*b* can rotate. The rear panel 112 may be coupled to the cabinet 101, and support the rear circular guide 120*b* that supports the load of the drum 110.

The rear panel 112 may include an intake duct 135 for taking air heated by the heater 130 into the drum 110. The rear panel 112 may have an intake hole for taking air into the drum 110 by communicating with the intake duct 135. The rear panel 112 may contact with the drum 110 at the rear side of the drum 110 to seal the rear side of the drum 110 such that air does not leak from the drum 110.

The heater 130 may heat air flowing into the drum 110. The heater 130 may heat air received from the outside through the cabinet 101, or may be connected to the exhaust duct 133 to heat air exhausted from the drum 110. Air heated by the heater 130 may flow into the drum 110 through the intake duct 135.

The drum 110 may rotate while holding laundry. The drum 110 may have a cylindrical shape with its front and rear sides opened such that laundry is loaded and air passes from the front side to the rear side. In this case, the front side of the drum 110 signifies the front direction of the cabinet 101, and the rear side of the drum 110 signifies the rear direction of the cabinet 101. Only one of the front and rear sides of the drum 110 may be opened, or both front and rear sides of the drum 110 may be opened. A lifter 115 may be provided on the inner surface of the drum 110 such that laundry held therein can be lifted and then dropped. According to embodiments, a lift module 150 may be provided on the inner surface of the drum 110, which will be described with reference to FIGS. 11A and 11B.

The drum 110 may be formed to have a cross-section of a noncircular looped curve in which a distance from the center of rotation is not uniform. A portion of the cross-section of the drum 110 may have a uniform curvature in which the distance from the center of rotation of the circular guides 120*a* and 120*b* is uniform. The drum 110 may be formed according to the shape of the cabinet 101 to secure the maximum space for holding laundry.

The drum 110 may be formed of elastic and flexible metal or highly-polymerized compound such that the drum 110 rotates while maintaining the cross-section of the noncircular looped curve. The inner surface of the drum 110 may be supported by the circular guides 120*a* and 120*b* and the auxiliary guides 140*a* and 140*b* such that the drum 110 rotates while maintaining the cross-section of the noncircular looped curve A portion of the drum 110 in which the cross-sectional curvature is uniform may be supported by the circular guides 120*a* and 120*b*. The other portion of the drum 110 that is not supported by the circular guides 120 and 120*b* may be supported by the auxiliary guides 140*a* and 140*b*. The inner surface of the front and rear sides of the drum 110 may be sealed by contact with the front panel 111 and the rear panel 112.

The circular guides 120*a* and 120*b* may support a portion of the drum 110 in which the cross-sectional curvature is uniform, and may have a ring-shape such that it is rotatably provided on the front panel 111 or the rear panel 112. The circular guides 120*a* and 120*b* may contact with the inner surface of the drum 110, and may support the drum by applying a normal force to the drum 110 in an outward direction. The circular guides 120*a* and 120*b* may support the load of the drum 110, and may rotate together with the drum 110.

The distance between the portion of the drum 110 supported by the circular guides 120*a* and 120*b* and the rotation center of the circular guides 120*a* and 120*b* may be uniform. The circular guides 120*a* and 120*b* may be disposed to support the inner surface of the upper portion of the drum 110 such that the rotation center of the circular guides 120*a* and 120*b* is located higher than the rotation center of the drum 110.

The circular guides 120*a* and 120*b* may contact with the inner surface of the drum 110 to the maximum to support the load of the drum 110. The circular guides 120*a* and 120*b* may be formed to have a sufficient size such that the rotation center of the drum 110 is located inside the circular guides 120*a* and 120*b*.

The circular guides 120*a* and 120*b* may contact with a portion of the drum 110 having a uniform cross-sectional curvature, and may rotate together with the drum 110, such that the drum 110 rotates while maintaining the cross-section of a noncircular looped curve. Friction between the circular guides 120*a* and 120*b* and the drum 110 may be maximized such that the circular guides 120*a* and 120*b* rotate together with the drum 110. Friction between the circular guides 120*a* and 120*b* and the front panel 111 or the rear panel 112 may be minimized such that the circular guides 120*a* and 120*b* can rotate.

The circular guides 120*a* and 120*b* may be provided in plurality. The circular guides 120*a* and 120*b* may include the front circular guide 120*a* supporting the inner surface of the front edge of the drum 110 and the rear circular guide 120*b* supporting the inner surface of the rear edge of the drum 110. The front circular guide 120*a* may be supported by the front panel 111, and the rear circular guide 120*b* may be supported by the rear panel 112.

The front circular guide 120*a* may be disposed around the panel loading hole 111' of the front panel 111 such that the panel loading hole 111' of the front panel 111 is disposed inside the front circular guide 120*a*. In other words, the panel loading hole 111' may be disposed inside the front circular guide 120*a* having a ring shape.

The auxiliary guides 140*a* and 140*b* may support a portion of the drum 111 that is not supported by the circular guides 120*a* and 120*b* such that the drum 110 rotates while maintaining the cross-section of the noncircular looped curve. The auxiliary guides 140*a* and 140*b* may be coupled to the front panel 111 or the rear panel 112 to support the drum 110 such that the drum 110 can rotate.

The auxiliary guides 140*a* and 140*b* may be disposed lower than the rotation center of the drum 110 to support the inner surface of the lower portion of the drum 110.

The auxiliary guides 140*a* and 140*b* may contact with the inner surface of the drum 110, and may generate a resilient force to apply a normal force to the drum 110 in an outward direction. Friction between the circular guides 120*a* and 120*b* and the drum 110 may be maximized, whereas friction between the auxiliary guides 140*a* and 140*b* and the drum 110 may be minimized.

The auxiliary guides 140*a* and 140*b* may be provided in plurality. The auxiliary guides 140*a* and the 140*b* may include the front auxiliary guide 140*a* supporting the inner surface of the front edge of the drum 110 and the rear auxiliary guide 140*b* supporting the inner surface of the rear edge of the drum 110.

FIG. 3 is a front view illustrating the inside of a laundry treating apparatus according to an embodiment of the present invention.

Figure 3A:
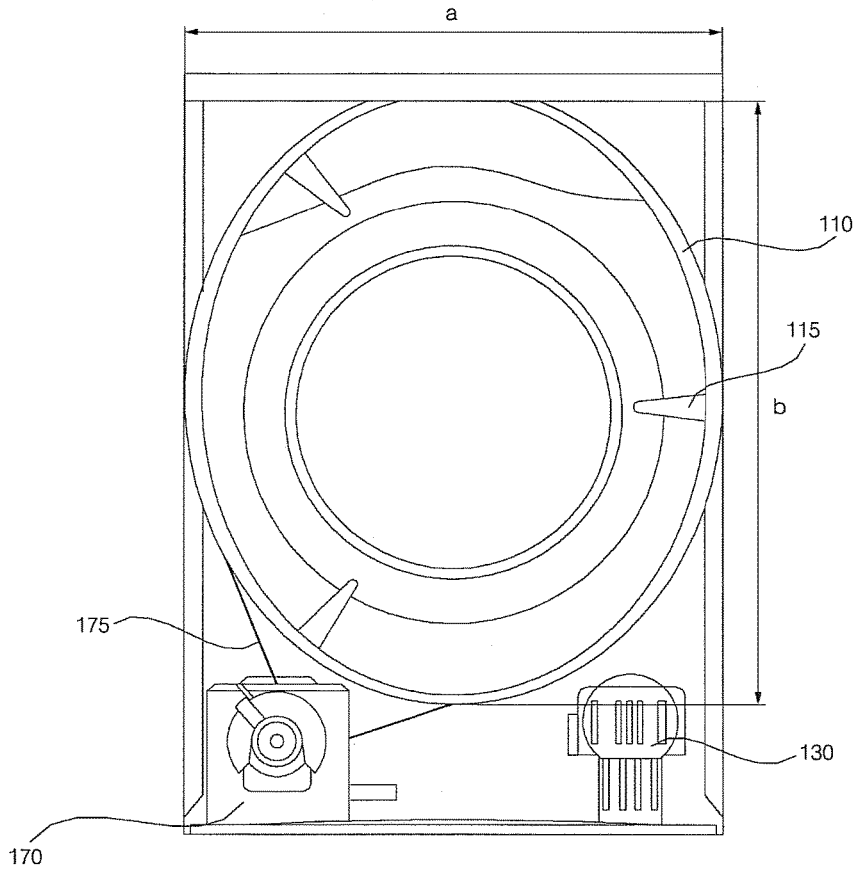
FIG. 3A is a front view illustrating the inside of a laundry treating apparatus according to an embodiment of the present invention.

Referring to FIG. 3A, the laundry treating apparatus may include a drum 110 having a cross-section of a noncircular looped curve in which a distance from the center of rotation is not uniform, a motor 170 generating a turning force, and a drive belt 175 receiving the turning force from the motor 170 and rotating the drum 110.

The drum 110 may be formed to have a cross-section of a noncircular looped curve in which a distance from the center of rotation is not uniform. According to the shape of the cabinet 101 having a rectangular shape in which the vertical length is greater than the horizontal length, the drum 110 may be formed to have a cross-section in which a distance b from top to bottom is greater than a distance a from left to right. A portion of the cross-section of the drum 110 may have a uniform curvature, i.e., uniform radius. Also, a portion of the cross-section of the drum 110 may be a straight line.

The drive belt 175 and the motor 170 may allow the drum 110 to rotate while maintaining the cross-section of a circular looped curve. The drive belt 175 may frictionally contact with the outer surface of the drum 110 to apply a normal force to the drum 110 in an inward direction, and may receive the turning force from the motor 170 to rotate the drum 110. The drive belt 175 may be formed of a flexible and elastic highly-polymerized compound or metal. The drive belt 175 may be formed of a material having a high friction coefficient so as not to slide on the outer surface of the drum 110. Alternatively, uneven portions may be formed on the inner surface of the drive belt 175 and the outer surface of the drum 110 such that the inner surface of the drive belt 175 and the outer surface of the drum 110 do not slide on each other.

The motor 170 may generate a turning force to transfer the drive belt 175. The turning force generated by the motor 170 may be delivered by the drive belt 175, and may rotate the drum 110.

Figure 3B:
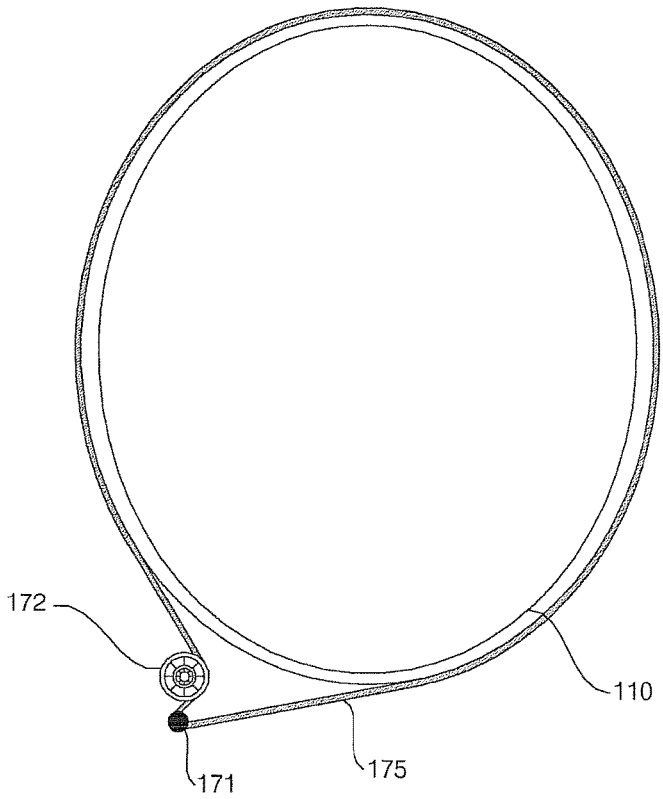
FIG. 3B is a view illustrating a method for operating a drum of a laundry treating apparatus according to an embodiment of the present invention.

FIG. 3B is a view illustrating a method for operating a drum of a laundry treating apparatus according to an embodiment of the present invention.

The laundry treating apparatus may include a belt tensioner 172. The belt tensioner 172 may contact with a portion of the drive belt 175 that does not contact with the drum 110 to apply a tensioning force to the drive belt 175.

Since the drive belt 175 contacts with a motor shaft 171 that is spaced from the drum 110, there is a portion of the drive belt 175 that does not contact with the drum 110. In other words, the drive belt 175 may partially contact with the outer surface of the drum 110. The belt tensioner 172 may minimize the portion of the drive belt 175 that does not contact with the drum 110, and may increase the tension of the drive belt 175.

As the tension of the drive belt 175 increases, a normal force which the drive belt 175 applies to the drum 110 in an inward direction may increase. Accordingly, the drum 110 may be smoothly supported by the circular guides 120*a* and 120*b* and/or the auxiliary guides 140*a* and 140*b*.

The belt tensioner 172 may be disposed near the motor shaft 174 of the motor 170 that rotates the drive belt 175 to contact with the drive belt 175. The belt tensioner 172 may contact with a surface other than a surface of the drive belt 175 that contacts with the drum 110 to minimize a portion of the drive belt 175 that does not contact with the drum 110.

Figure 3C:
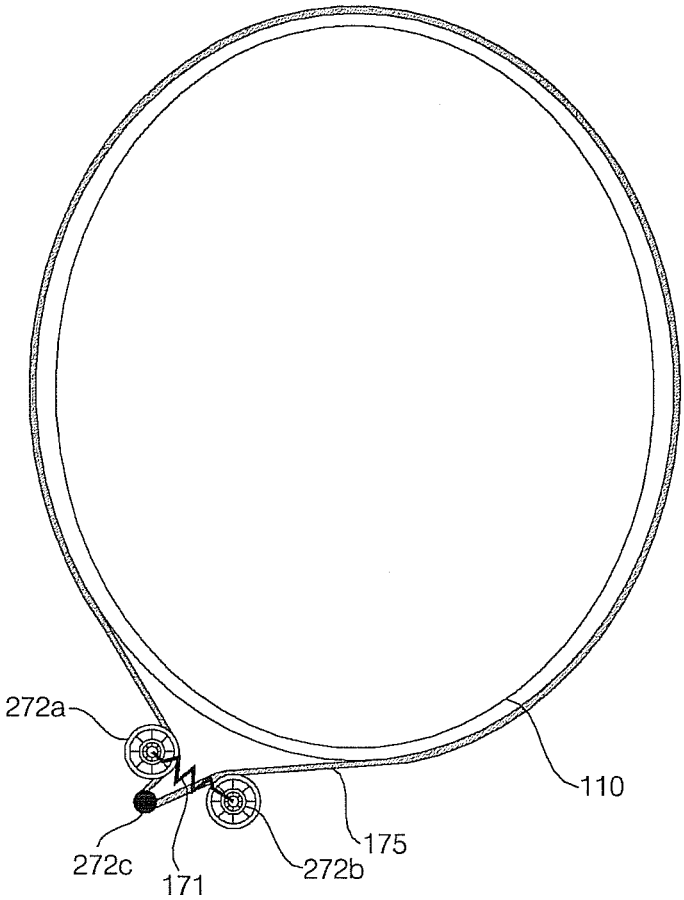
FIG. 3C is a view illustrating a method for operating a drum of a laundry treating apparatus according to another embodiment of the present invention.

FIG. 3C is a view illustrating a method for operating a drum of a laundry treating apparatus according to another embodiment of the present invention.

The laundry treating apparatus may include a first belt tensioner 272*a* and a second belt tensioner 272*b*, and a tensioner elastic member 272*c*. The first belt tensioner 272*a* and the second belt tensioner 272*b* may contact with a portion of the drive belt 175 that does not contact with the drum 110. The tensioner elastic member 272*c* may connect the first belt tensioner 272*a* and the second belt tensioner 272*b*.

The first belt tensioner 272*a* and the second belt tensioner 272*b* may be symmetrically disposed across the motor shaft 171 to contact with the drive belt 175 at different locations. The tensioner elastic member 272*c* may generate an elastic force such that the first belt tensioner 272*a* and the second belt tensioner 272*b* pull each other, and may connect between the first belt tensioner 272*a* and the second belt tensioner 272*b* to minimize a portion of the drive belt 175 that does not contact with the drum 110. Also, the first belt tensioner 272*a* and the second belt tensioner 272*b* may increase the tension of the drive belt 175 to maximize the friction between the drive belt 175 and the drum 110, and may increase a normal force that the drive belt 175 applies to the drum 110 in an inward direction to allow the drum 110 to be smoothly supported by the circular guides 120*a* and 120*b* and/or the auxiliary guides 140*a* and 140*b*.

Figure 4A:
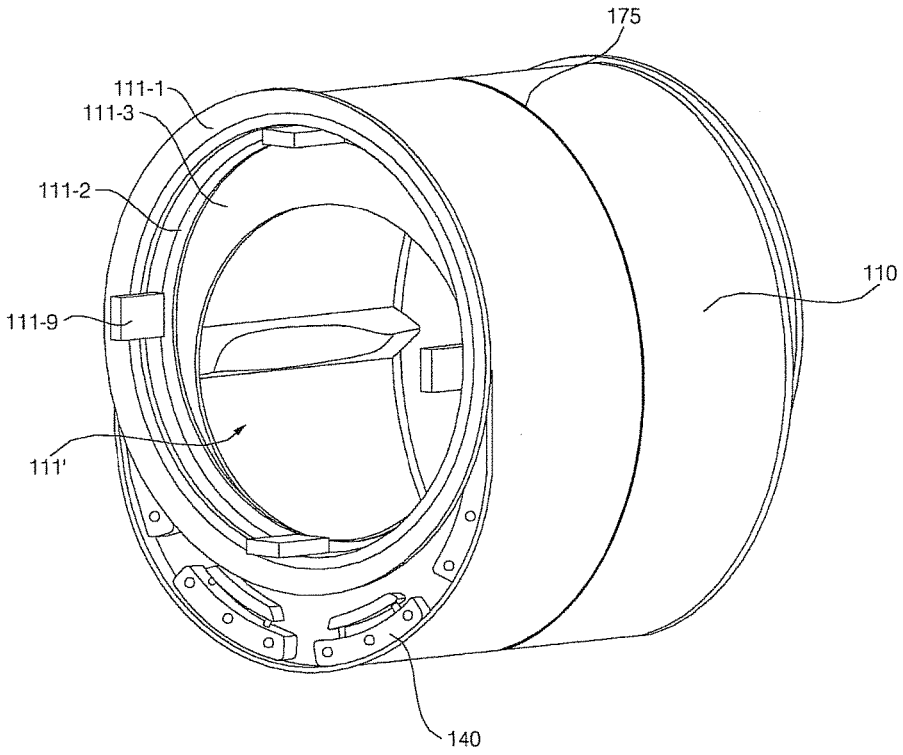
FIG. 4A is a perspective view illustrating the inside of a laundry treating apparatus according to an embodiment of the present invention.
Figure 4B:
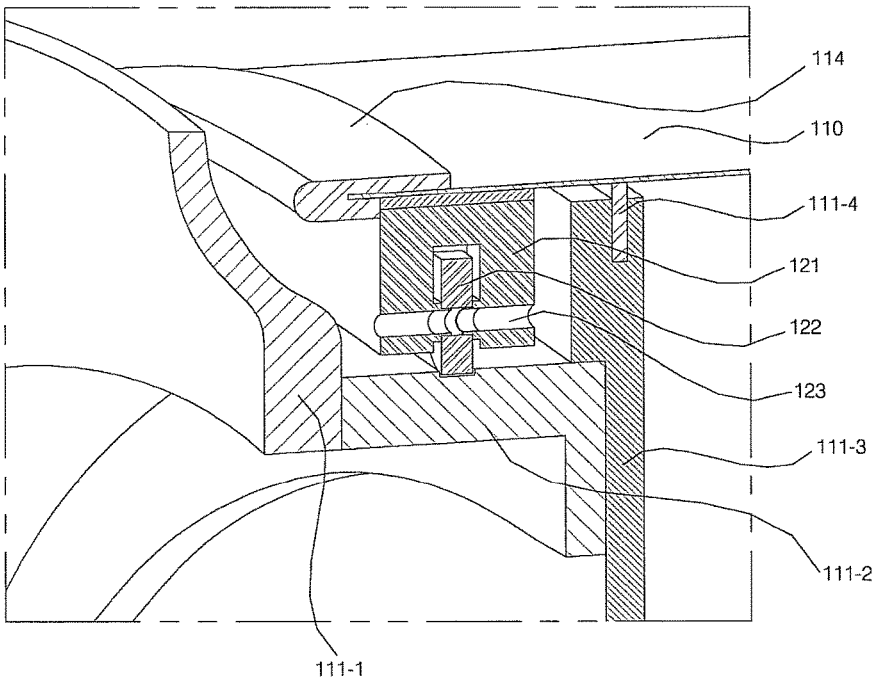
FIG. 4B is a cross-sectional view illustrating a portion of a laundry treating apparatus according to an embodiment of the present invention.

FIG. 4A is a perspective view illustrating the inside of a laundry treating apparatus according to an embodiment of the present invention. FIG. 4B is a cross-sectional view illustrating a portion of a laundry treating apparatus according to an embodiment of the present invention.

The front panel 111 of the laundry treating apparatus may include a front circular guide seating part 111-2, a front sealing panel 111-3, a front panel protector 111-1, and a front panel coupling member 111-9. The front circular guide seating part 111-2 may be seated such that the front circular guide 120*a* can rotate. The front sealing panel 111-3 may contact with the inner surface of the front side of the drum 110 to seal the front side of the drum 110. The front panel protector 111-1 may prevent the drum 110 from projecting forward. The front panel coupling member 111-9 may be coupled to the rear side of the front surface of the cabinet 101.

The front circular guide 120*a* may include a friction-reducing member 122 that contacts with the front circular guide seating part 111-2 of the front panel 111 and reduces friction, and a circular guide bracket 121 coupled to the friction-reducing member 122 and supporting the inner surface of the drum 110.

Also, the laundry treating apparatus may further include a drum sealer 114 that is disposed at the front edge of the drum 110 to seal a gap between the front side of the drum 110 and the front circular guide 120*a*.

The front circular guide seating part 111-2 may be seated such that the front circular guide 120*a* can rotate. The front circular guide seating part 111-2 may be formed to have a ring shape corresponding to the shape of the front circular guide 120*a* to support the inner side of the front circular guide 120*a*. The front circular guide seating part 111-2 may contact with the friction-reducing member 122 of the front circular guide 120*a*.

The front side (front surface of the cabinet 101) of the front circular guide seating part 111-2 may be coupled to the front panel protector 111-1, and the rear side (drum 110) thereof may be coupled to the front sealing panel 111-3. The front circular guide sealing part 111-2 may be concentrically coupled to the front panel protector 111-1. The front circular guide sealing part 111-2 may be disposed over the front sealing panel 111-3 such that the center of the front circular guide sealing part 111-2 is located higher than the center of the front sealing panel 111-3. The front circular guide sealing part 111-2 may be formed to have a sufficient size such that the rotation center of the drum 110 is located therein.

The front circular guide seating part 111-2 may be disposed around the panel loading hole 111' to allow laundry to be loaded and unloaded to/from the drum 110. In other words, the front circular guide seating part 111-2 having a ring shape may be provided such that the panel loading hole 111' is disposed therein.

When laundry is loaded and the drum 110 rotates, an imbalanced distribution of laundry may cause an unbalance in which the geometrical center of the rotation axis of the drum 110 discords with the actual center of gravity, generating vibration of the drum 110. Due to the axial vibration and/or vertical vibration of the drum 110, the drum 110, the front circular guide 120*a*, and the front circular guide seating part 111-2 of the front panel 111 may be separated from each other. Since the front circular guide 120*a* is seated on the front circular guide seating part 111-2 between the front panel protector 111-1 and the front sealing panel 111-3, the front circular guide 120*a* may be prevented from being separated toward the front side or the rear side of the front circular guide seating part 111-2 due to vibration caused by the unbalance of the drum 110.

The front circular guide seating part 111-2 may be coupled to the front panel coupling member 111-9 coupled to the rear side of the front surface of the cabinet 101.

The front sealing panel 111-3 may be formed according to the shape of the drum 110, and may contact with the inner surface of the front side of the drum 110. The front sealing panel 111-3 may be formed to have a cross-section of a noncircular looped curve in which a distance from the center is not uniform according to the shape of the drum 110. The front sealing panel 111-3 may have a panel loading hole 111' through which laundry is loaded and unloaded to/from the drum 110. The front sealing panel 111-3 may have an exhaust hole that communicates with the exhaust duct 133 to exhaust air from the drum 110.

The front sealing panel 111-3 may be coupled to the rear side of the front circular guide seating part 111-2. The front sealing panel 111-3 may project outward compared to the front circular guide seating part 111-2 to prevent the front circular guide 120*a* from being separated backward due to vibration caused by the unbalance of the drum 110.

The front circular guide seating part 111-2 may be disposed around the panel loading hole 111' of the front sealing panel 111-3 to allow laundry to be loaded and unloaded to/from the drum 110. In other words, the front circular guide sealing part 111-2 having a ring shape may be provided such that the panel loading hole 111' is disposed therein.

The front sealing panel 111-3 may include a panel sealer 111-4 that contacts the inner surface of the front side of the drum 110 while reducing friction therebetween. The panel sealer 111-4 may be formed of a synthetic material mixed with polytetrafluoroethylene (PTFE) oil having a low friction coefficient to seal the front side of the drum 110 and reduce the friction therebetween. The panel sealer 111-4 may be formed of a fabric or rubber material.

The front sealing panel 111-3 may be coupled to the auxiliary guides 140*a* and 140*b* under a portion where the front circular guide seating part 111-2 is coupled. The auxiliary guides 140*a* and 140*b* may be fixedly coupled to the lower portion of the front sealing panel 111-3 to support a portion of the drum 110 that is not supported by the circular guides 120*a* and 120*b*.

The front panel protector 111-1 may be formed to have a ring shape according to the shape of the front circular guide seating part 111-2. The front panel protector 111-1 may be coupled to the front side of the front circular guide seating part 111-2.

The front panel protector 111-1 may project outward compared to the drum 110 to prevent the drum 110 from projecting forward. The front panel protector 111-1 may be bent such that the outer edge thereof faces the front surface of the cabinet 101, allowing the drum to project forward to a certain extent. However, the drum 110 excessively projects due to vibration caused by the unbalance of the drum 110, the front panel protector 111-1 may contact with the drum sealer 114 to prevent the drum 110 from excessively projecting.

The front panel protector 111-1 may outwardly project compared to the front circular guide seating part 111-2 to prevent the front circular guide 120 from being separated forward due to vibration caused by the unbalance of the drum 110. The front panel protector 111-1 may be coupled to the front panel coupling member 111-9 coupled to the rear side of the front surface of the cabinet 101.

The front panel coupling member 111-9 may couple the front circular guide seating part 111-2, the front panel protector 111-1, and the rear side of the front surface of the cabinet 101 to allow the front circular guide seating part 111-2 to support the load of the drum 110.

The friction-reducing member 122 may contact with the front circular guide seating part 111-2 such that the front circular guide bracket 121 can rotate while supporting the load of the drum 110. The friction-reducing member 122, which is a sort of bearing, may be variously implemented according to embodiments. In the present embodiment, the friction-reducing member 122 may be a rotatable circular guide roller 122 that rolls along the front circular guide seating part 111-2. The circular guide roller 122 may be provided with a roller axis 123 that allows the circular guide roller 122 to be rotatably coupled to the circular guide bracket.

The circular guide bracket 121 may contact with the inner surface of the drum to support the drum by applying a normal force to the drum 110 in an outward direction. Friction between the circular guide bracket 121 and the inner surface of the drum 110 may be maximized such that the circular guide bracket 121 rotates together with the drum 110. In other words, a material having a high friction coefficient may be coated on the upper surface of the circular guide bracket 121 that contacts with the inner surface of the drum 110.

The friction-reducing member 122 may be disposed under the circular guide bracket 121. The side surface of the front of the circular guide bracket 121 may contact with the drum sealer 114 to seal the front of the drum 110.

The drum sealer 114 may surround the edge of the front of the drum 110. The drum sealer 114 may contact with the side surface of the front of the circular guide bracket 121 to seal a gap between the front side of the drum 110 and the front circular guide 120*a*. The drum 110 may contact with the panel sealer 111-4 to be primarily sealed, and the drum sealer 114 may contact with the circular guide bracket 121 to be secondarily sealed. Even when the primary sealing by the panel sealer 111-4 is released due to vibration caused by the unbalance of the drum 110, leakage of air of the drum 110 may be stopped by the secondary sealing of the drum sealer 114.

The drum sealer 114 may contact with the side surface of the front of the circular guide bracket 121 to prevent the drum 110 from being separated from the circular guide bracket 121 due to the vibration caused by the unbalance of the drum 110 and prevent the front circular guide 120*a* from being separated.

The drum sealer 114 may contact with the front panel protector 111-1 when the drum 110 excessively projects forward due to the vibration caused by the unbalance of the drum 110. The drum sealer 114 may contact with the front panel protector 111-1 to prevent the drum 110 to excessively project forward, and seal a gap between the drum 110 and the front panel protector 111-1. Accordingly, even when the primary seal and secondary sealing are released due to excessive vibration of the drum 110, the drum 110 may be tertiarily sealed because the drum sealer 114 contacts with the front panel protector 111-1.

The drum sealer 114 may be formed of a material having a low friction coefficient such that the drum 110 can smoothly rotate in spite of contact with the front panel protector 111-1. The drum sealer 114 may be formed of a synthetic material mixed with PTFE oil similarly to the panel sealer 111-4, and may be formed of a fabric or rubber material. The drum sealer 114 may also be provided on the rear edge of the drum 110.

A description of the above-mentioned front panel 111 and front circular guide 120*a* may be applied to the rear panel 112 and rear circular guide 120*b*.

The rear panel 112 may include a rear circular guide seating part (not shown), a rear sealing panel (not shown), a rear panel protector (not shown), and a rear panel coupling member (not shown). The rear circular guide seating part may be seated such that the rear circular guide 120*b* can rotate. The rear sealing panel may contact with the inner surface of the rear side of the drum 110 to seal the rear side of the drum 110. The rear panel protector may prevent the drum 110 from projecting backward. The rear panel coupling member may be coupled to the rear side of the rear surface of the cabinet 101

Also, the rear circular guide 120*b* may include a friction-reducing member (not shown) and a circular guide bracket (not shown). The friction-reducing member may contact with the rear circular guide seating part, and reduce friction. The circular guide bracket may be coupled to the friction-reducing member, and contact the inner surface of the drum 110 to support.

A description of the respective components will be substituted with the above-mentioned description. However, in the rear sealing panel, the panel loading hole 111' may not be formed, and an intake hole through which air flows into the drum 110 by communicating with the intake duct 135 may be formed instead of an exhaust hole. Also, the direction of the displacement and shape of the respective components may be changed.

FIGS. 5A through 5D are views illustrating circular guides of laundry treating apparatuses according to different embodiments of the present invention.

Figure 5A:
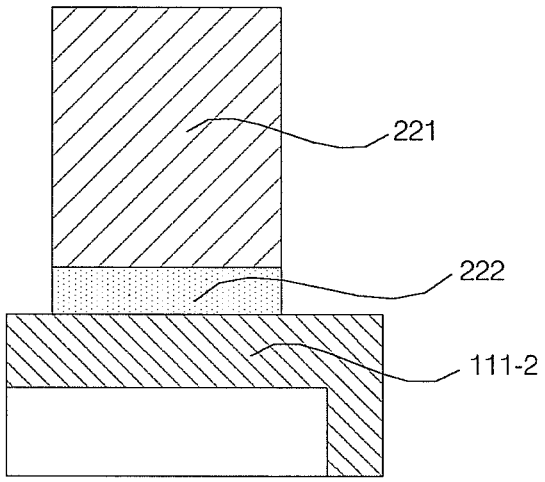
FIGS. 5A through 5D are views illustrating circular guides of laundry treating apparatuses according to different embodiments of the present invention.

Referring to FIG. 5A, a friction-reducing member of the front circular guide 120*a* may be formed as a sliding member 222. The sliding member 222 may contact with the front circular guide seating part 111-2 by their surfaces. The sliding member 222 may be formed of a slidable member that minimizes friction. A fluid film may be formed as a lubricant between the sliding member 222 and the front circular guide seating part 111-2 to minimize friction. The sliding member 222 may be coupled to the circular guide bracket 221, and the circular guide bracket 221 may support the inner surface of the drum 110.

Figure 5B:
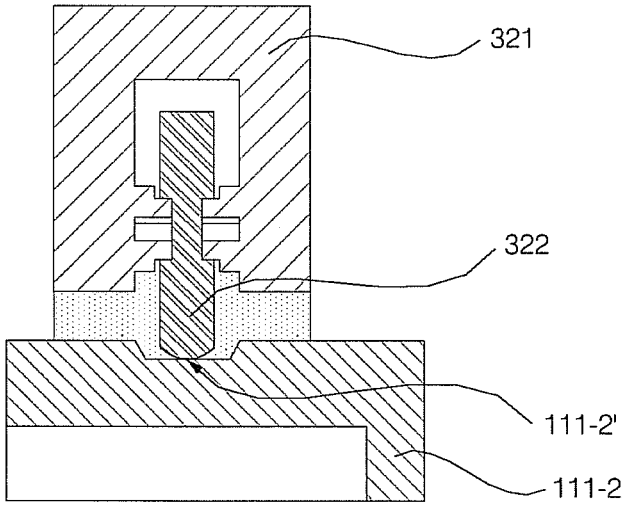

Referring to FIG. 5B, a friction-reducing member of the front circular guide 120*a* may be formed as a circular guide roller 322 rotatably installed in a circular guide bracket 321. A circular guide seating groove 111-2' in which a portion of the circular guide roller 322 is inserted and seated may be formed in the front circular guide seating part 111-2. Since the circular guide roller 322 is partially inserted into the circular guide seating groove 111-2' and rotates, the circular guide roller 322 may be prevented from being separated from the front circular guide seating part 111-2 due to vibration caused by the unbalance of the drum 110.

Figure 5C:
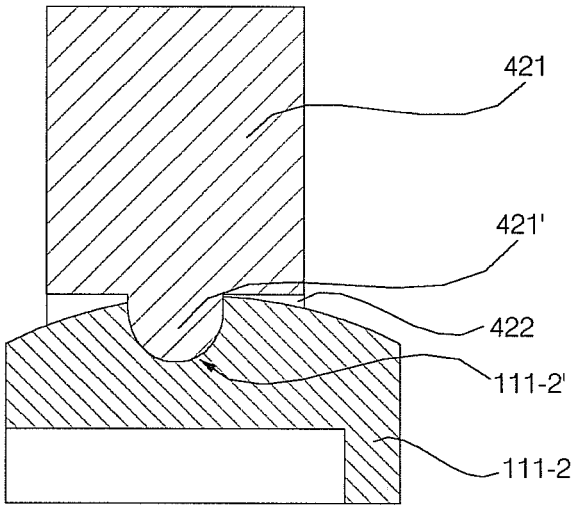

Referring to FIG. 5C, the circular guide bracket 421 may include a bracket protrusion 421' projecting downward and having a round shape. The bracket protrusion 421' may be inserted into the circular guide seating groove 111-2' that is formed in the front circular guide seating part 111-2. The bracket protrusion 421' may be inserted into the circular guide seating groove 111-2' to reduce friction, and may prevent the bracket protrusion 421' from being separated from the front circular guide seating part 111-2 due to vibration caused by the unbalance of the drum 110. A friction-reducing member 422, which is a lubricant formed as a fluid film, may be filled between the circular guide bracket 121 and the front circular guide seating part 111-2.

Figure 5D:
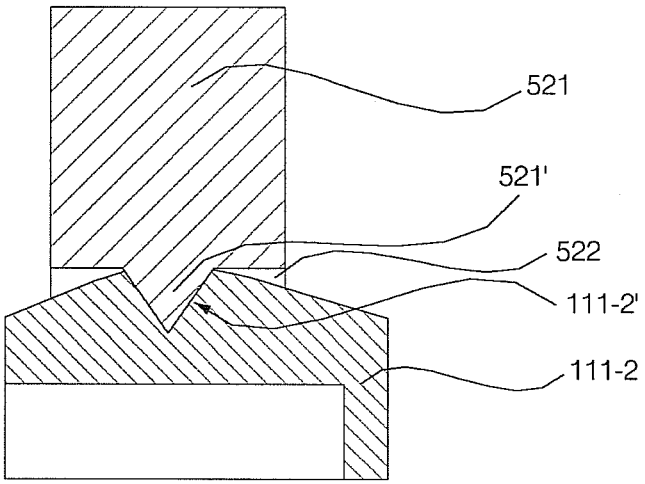

Referring to FIG. 5D, the circular guide bracket 521 may include a bracket protrusion 521' downwardly projecting with a wedge shape and a friction reducing member 522. A detailed description of other parts will be substituted with the description of FIG. 5C.

Although it has been exemplified in FIGS. 5A through 5D that the front circular guide 120*a* and the front circular guide seating part 111-2, the description of the rear circular guide 120*b* and the rear circular guide seating part (not shown) can be applied.

Figure 6A:
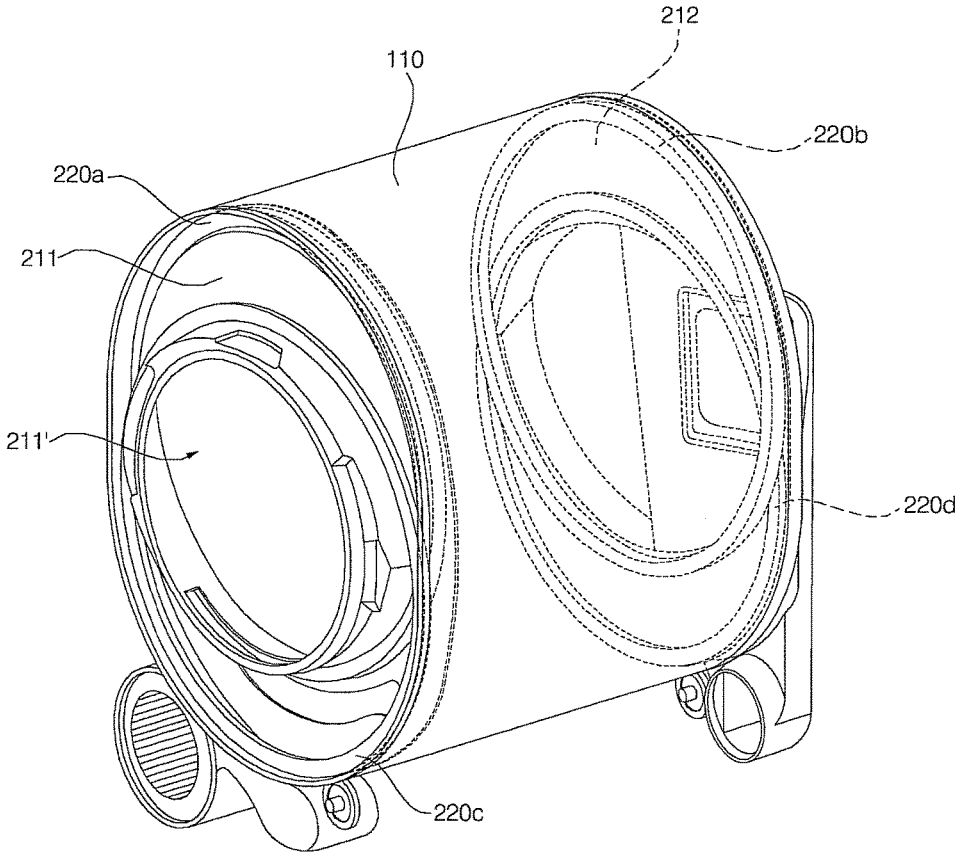
FIG. 6A is a perspective view illustrating the inside of a laundry treating apparatus according to another embodiment of the present invention.
Figure 6B:
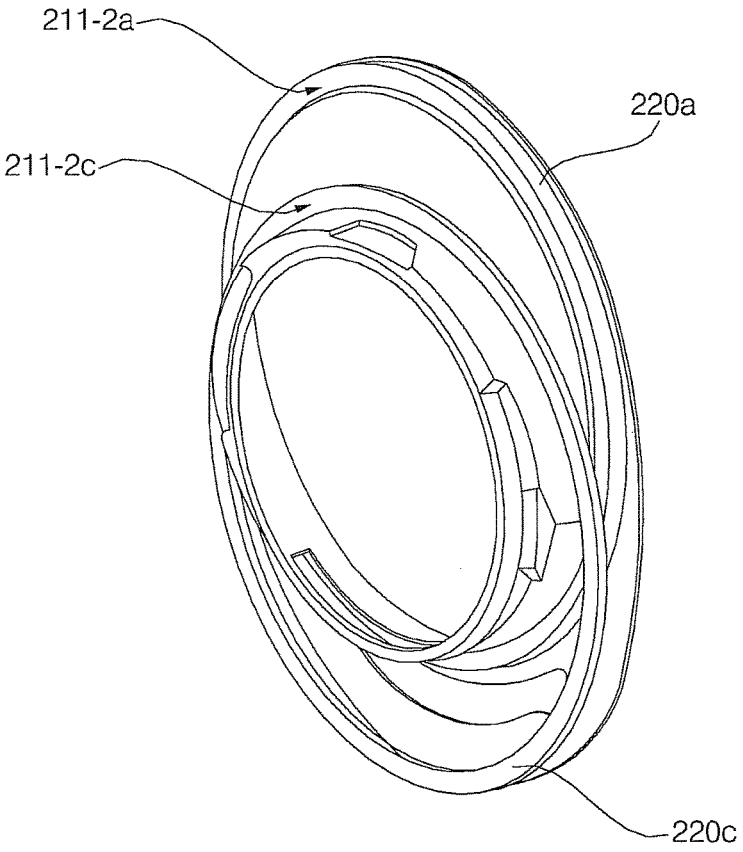
FIG. 6B is a perspective view illustrating a front panel of the laundry treating apparatus shown in FIG. 6A.
Figure 6C:
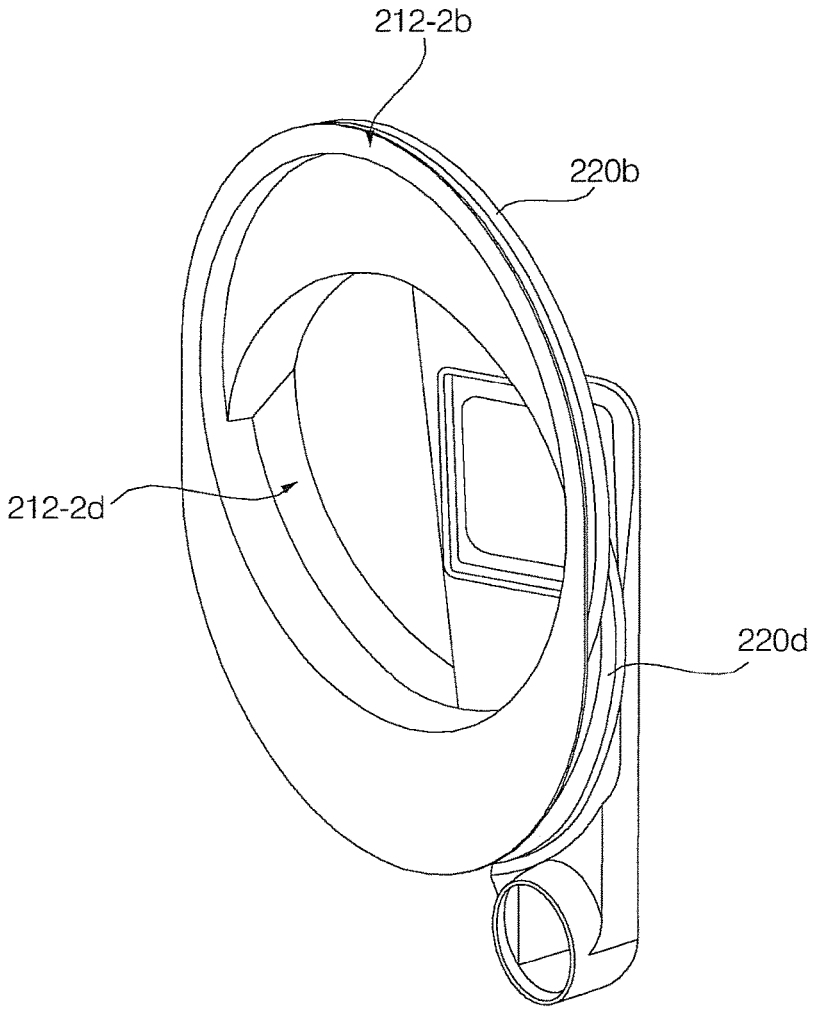
FIG. 6C is a perspective view illustrating a rear panel of the laundry treating apparatus shown in FIG. 6A.

FIG. 6A is a perspective view illustrating the inside of a laundry treating apparatus according to another embodiment of the present invention. FIG. 6B is a perspective view illustrating a front panel of the laundry treating apparatus shown in FIG. 6A. FIG. 6C is a perspective view illustrating a rear panel of the laundry treating apparatus shown in FIG. 6A.

The laundry treating apparatus may include upper circular guides 220*a* and 220*b* and lower circular guides 220*c* and 220*d*. The rotation center of the upper circular guides 220*a* and 220*b* may be higher than the rotation center of a drum 110, and may support the inner surface of the upper portion of the drum 110. The rotation center of the lower circular guides 220*c* and 220*d* may be lower than the rotation center of the drum 110, and may support the inner surface of the lower portion of the drum 110.

The upper circular guides 220*a* and 220*b* may contact with an upper portion of the drum 110 in which the section curvature is uniform, and may rotate together with the drum 110. The upper circular guides 220*c* and 220*d* may contact with a lower portion of the drum 110 in which the section curvature is uniform, and may rotate together with the drum 110. The upper circular guides 220*a* and 220*b* and the lower circular guides 220*c* and 220*d* may rotatably support the front panel 211 or the rear panel 212 while minimizing friction therebetween.

The upper circular guides 220*a* and 220*b* and the lower circular guides 220*c* and 220*d* may be provided in plurality. The upper front circular guide 220*a* and the lower front circular guide 220*c* supported by the front panel 211, and the upper rear circular guide 220*b* and the lower rear circular guide 220*d* supported by the rear panel may be provided.

The upper front circular guide 220*a* and the lower front circular guide 220*c* may cross each other, and may be supported by an upper front circular guide seating part 211-2*a* and a lower front circular guide seating part 211-2*c* of the front panel 211 in a contact manner, respectively. The upper front circular guide 220*a* and the lower front circular guide 220*c* may be provided around a panel loading hole 211' of the front panel 211. In other words, the upper front circular guide 220*a* and the lower front circular guide 220*c* may be disposed such that the panel loading hole 211' is located therein.

The upper rear circular guide 220*b* and the lower rear circular guide 220*d* may cross each other, and may be supported by an upper rear circular guide seating part 212-2*b* and a lower rear circular guide seating part 212-2*d* of the rear panel 212 in a contact manner, respectively.

Figure 7A:
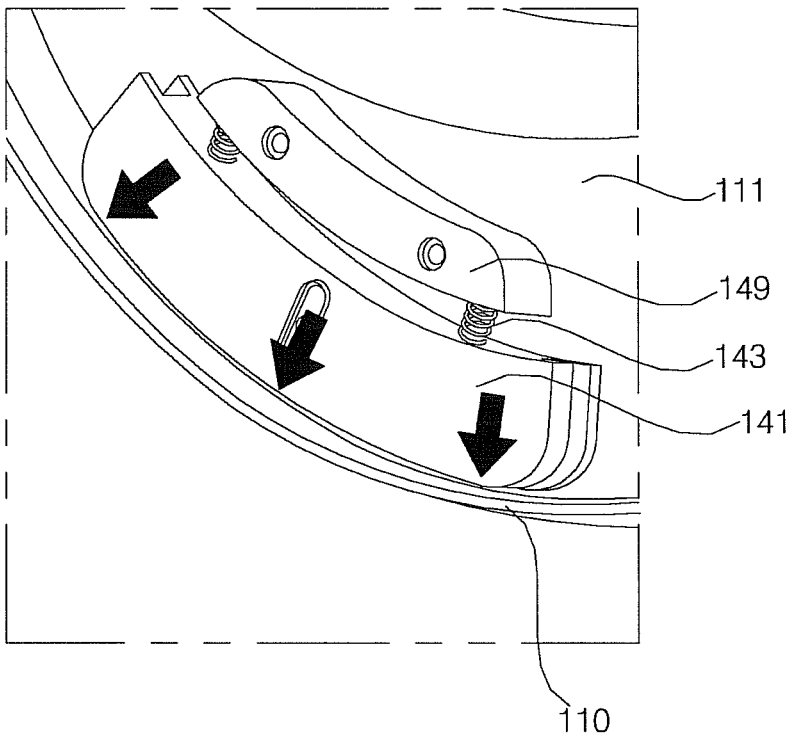
FIGS. 7A through 7C are views illustrating auxiliary guides of laundry treating apparatuses according to different embodiments of the present invention.
Figure 7B:
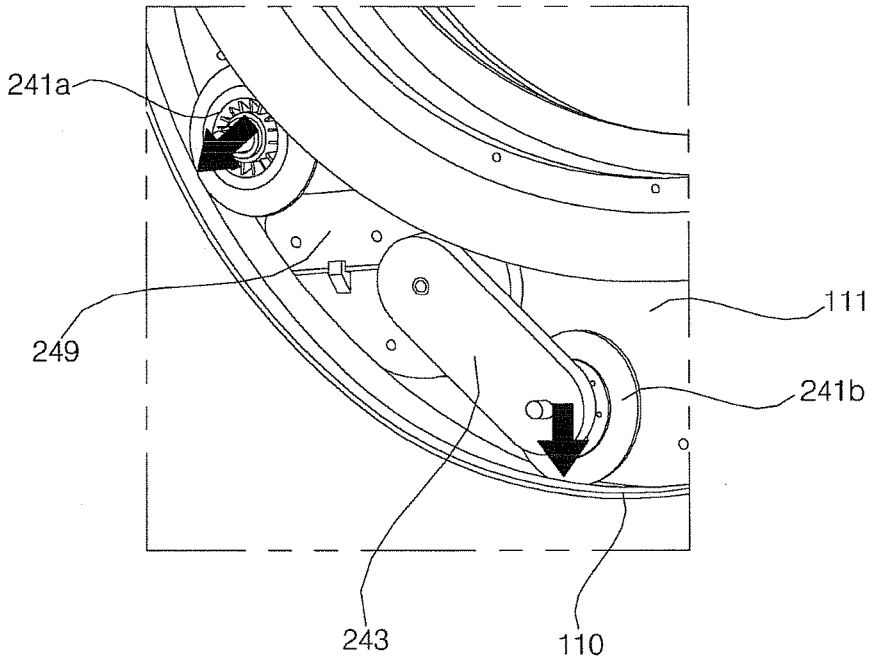
Figure 7C:
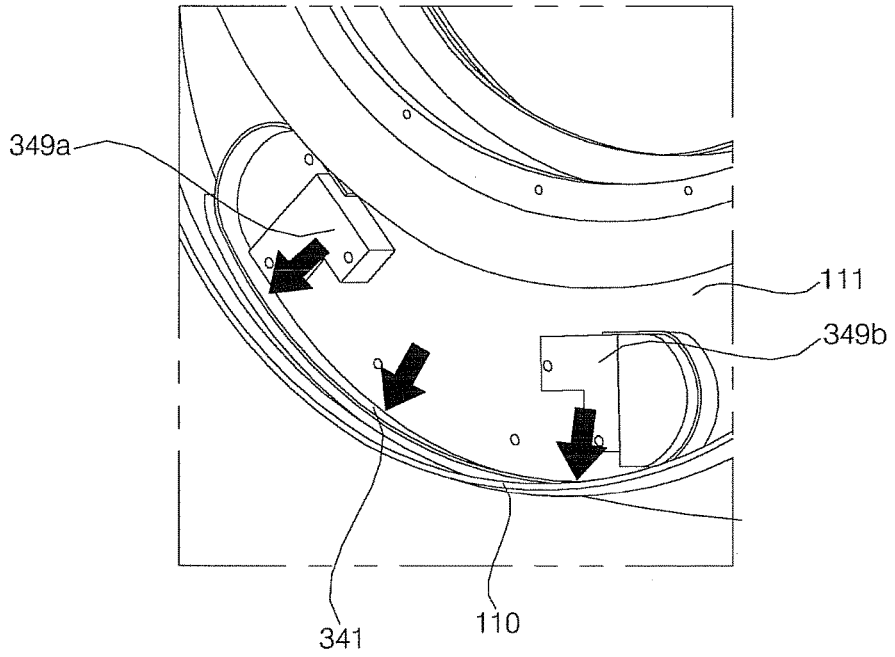

FIGS. 7A through 7C are views illustrating auxiliary guides of laundry treating apparatuses according to different embodiments of the present invention.

Referring to FIG. 7A, the auxiliary guides 140*a* and 140*b* may include an auxiliary guide slider 141 contacting with the inner surface of the drum to support, an auxiliary guide elastic member 143 applying an elastic force to the auxiliary guide slider 141 such that the auxiliary guide slider 141 applies a force to the drum 110 in an outward direction, and an auxiliary guide coupling part 149 fixedly coupled to the front panel 111 and coupled to the auxiliary guide elastic member 143.

The auxiliary guide slider 141 may contact with the inner surface of the drum 110 and support the drum 110 such that the drum 110 rotates while maintaining the cross-section of a noncircular looped curve. The auxiliary guide slider 141 may support a portion of the drum 110 that is not supported by the circular guides 120*a* and 120*b*. The auxiliary guide slider 141 may be formed of a slidable member having a low friction coefficient such that the auxiliary guide slider 141 slidably contacts with the drum 110. Alternatively, a material having a low friction coefficient may be provided on a portion that contacts with the drum 110.

The auxiliary guide slider 141 may receive an elastic force from the auxiliary guide elastic member 143, and may apply a force to the drum 110 in an outward direction to support the drum 110. In other words, the auxiliary guide slider 141 may apply a normal force to the drum in an outward direction. The auxiliary guide elastic member 143 may be formed of a compressed coil spring to apply an elastic force to the auxiliary guide slider 141. The auxiliary guide coupling part 149 may be fixedly coupled to the lower portion of the front sealing panel 111-3 of the front panel 111.

Referring to FIG. 7B, the auxiliary guides 140*a* and 140*b* may include a plurality of auxiliary guide rollers 241 (for example, auxiliary guide rollers 241*a* and 241*b* as shown in FIG. 7B) that contacts with the inner surface of the drum and rotatably supports the drum 110, an auxiliary guide support part 243 that rotatably supports the auxiliary guide roller 241, and an auxiliary guide coupling part 249 that is coupled to the auxiliary guide support part 243 and fixedly coupled to the front panel 111. An auxiliary guide elastic member (not shown) may be provided between the auxiliary guide support part 243 and the auxiliary guide coupling part 249 to apply an elastic force to the auxiliary guide support part 243.

The auxiliary guide roller 241 may contact with the inner surface of the drum 110 and support the drum 110 such that the drum 110 rotates while maintaining the cross-section of a noncircular looped curve. The auxiliary guide roller 241 may support a portion of the drum that is not supported by the circular guides 120*a* and 120*b*. The auxiliary guide roller 241 may be formed as a rotational body that rolls along the drum 110, minimizing friction with the drum 110.

The auxiliary guide roller 241 may be rotatably supported by the auxiliary guide support part 243. The auxiliary guide support part 243 may be rotatably coupled to the auxiliary guide coupling part 249, and may receive an elastic force from the auxiliary guide elastic member to generate a torque in a direction of the inner surface of the drum 110. The auxiliary guide roller 241 may receive a force from the auxiliary guide support part 243 to apply the force to the drum 110 in an outward direction and support the drum 110. In other words, the auxiliary guide roller 241 may apply a normal force to the drum 110 in an outward direction.

The auxiliary guide elastic member may be formed of a torsion spring to apply an elastic force to the auxiliary guide support part 243. The auxiliary guide coupling part 249 may be fixedly coupled to the lower portion of the front sealing panel 111-3 of the front panel 111.

Referring to FIG. 7C, the auxiliary guides 140*a* and 140*b* may include an auxiliary guide plate spring 341 that contacts with the inner surface of the drum 110 and supports the drum 110, and a plurality of auxiliary guide coupling parts 349 (for example, auxiliary guide coupling parts 349*a* and 349*b* as shown in FIG. 7C) that support the auxiliary guide plate spring 341 and are fixedly coupled to the front panel 111.

The auxiliary guide plate spring 341 may contact with the inner surface of the drum 110 and support the drum 110 such that the drum rotates while maintaining a cross-section of a noncircular looped curve. The auxiliary guide plate spring 341 may support a portion of the drum 110 that is not supported by the circular guides 120*a* and 120*b*. The auxiliary guide plate spring 341 may be formed of a material having a low friction coefficient such that the auxiliary guide plate spring 341 slidably contacts with the drum 110. Alternatively, a material having a low friction coefficient may be provided on a portion that contacts with the drum 110.

The auxiliary guide plate spring 341 may generate an elastic force, and may apply the elastic force to the drum in an outward direction. The auxiliary guide coupling part 349 may be coupled to both ends of the auxiliary guide plate spring 341, and may be fixedly coupled to the lower portion of the front sealing panel 111-3 of the front panel 111.

Figure 8A:
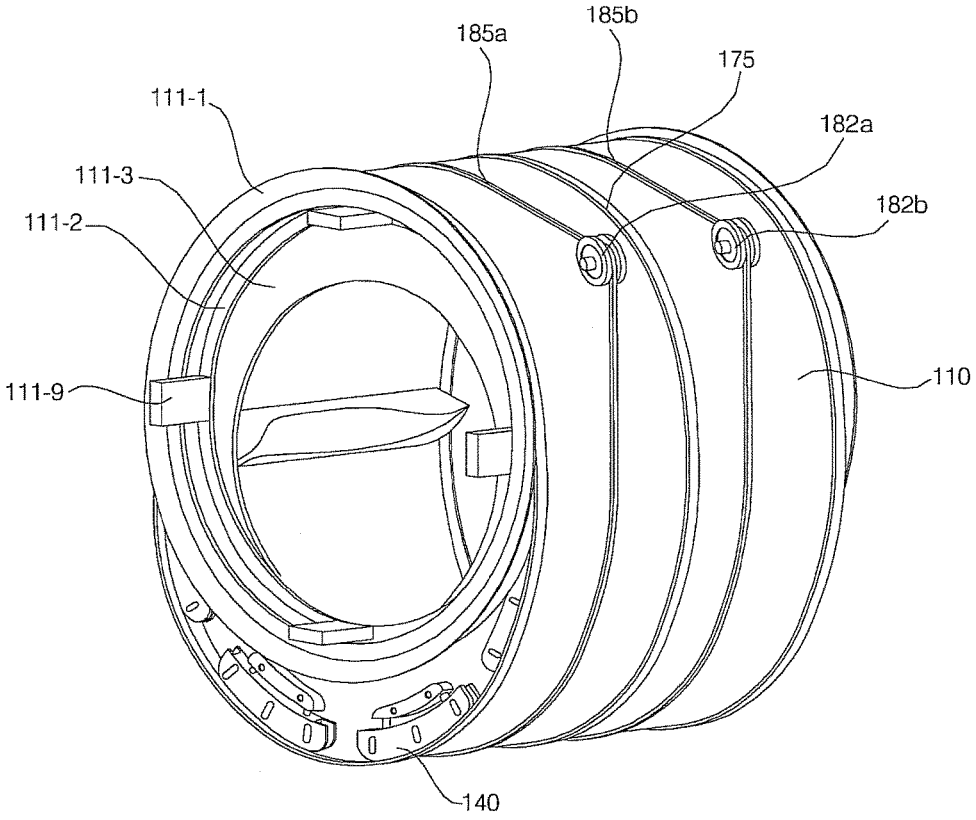
FIG. 8A is a perspective view illustrating the inside of a laundry treating apparatus according to an embodiment of the present invention.
Figure 8B:
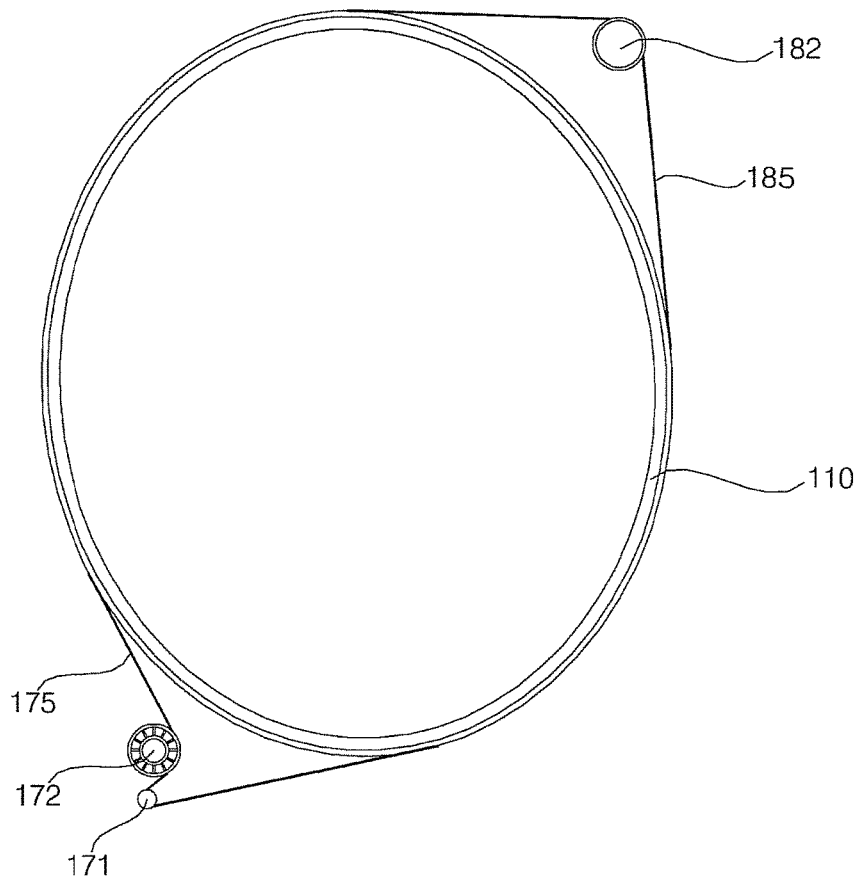
FIG. 8B is a front view illustrating the inside of the laundry treating apparatus shown in FIG. 8A.

FIG. 8A is a perspective view illustrating the inside of a laundry treating apparatus according to an embodiment of the present invention. FIG. 8B is a front view illustrating the inside of the laundry treating apparatus shown in FIG. 8A.

The laundry treating apparatus may include an auxiliary belt 185 contacting with a portion that is not contacted by the drive belt 175, and an idler 182 contacting with the auxiliary belt 185 and applying a tension to the auxiliary belt 185.

The auxiliary belt 185 (for example, auxiliary belts 185*a* and 185*b* as shown in FIG. 8A) may contact with a portion of the drum 110 that is not contacted by the drive belt 175. The auxiliary belt 185, as shown in FIG. 8B, may contact with a portion of the drum 110 that is not contacted by the drive belt 175 when viewed from the front. The auxiliary belt 185 may support the drum 110 by applying a normal force to a portion of the drum 110 to which the drive belt 175 does not apply a normal force in an inward direction.

The auxiliary belt 185 may support the load of the drum 110 by contacting with a portion of the drum 110 to which the motor 170 is adjacent. The auxiliary belt 185 may support the load of the drum 110 that varies with the amount of laundry such that the drum 110 can rotate while maintaining a cross-section of a noncircular looped curve. Also, the auxiliary belt 185 may prevent the drive belt 175 from being broken, by jointly supporting the load of the drum 110 together with the drive belt 175.

The auxiliary belt 185 may prevent air inside the drum 110 from leaking, by supporting the outer surface of the lower portion of the drum 110 such that the drum 110 does not lean to the motor 170.

The auxiliary belt 185 may frictionally contact with the outer surface of the drum 110, and may rotate together with the drum 110. The auxiliary belt 185 may be formed of a flexible and elastic high-polymerized compound or metal. The auxiliary belt 185 may be formed of a material having a high friction coefficient so as not to slide on the outer surface of the drum 110. Alternatively, uneven portions may be formed on the inner surface of the auxiliary belt 185 and the outer surface of the drum 110 such that the inner surface of the auxiliary belt 185 and the outer surface of the drum 110 do not slide on each other.

The idler 182 (for example, idlers 182*a* and 182*b* as shown in FIG. 8A) may contact with the auxiliary belt 185 to apply a tension to the auxiliary belt 185. The idler 182 may be located at the opposite side to the motor 170 across the rotation center of the drum 110. The idler 182 may contact with the auxiliary belt 185 at the opposite side to the motor 170 to allow the auxiliary belt 185 to apply a maximum normal force to a portion of the drum 110 to which the drive belt 175 does not apply a normal force in an inward direction.

The idler 182 may maximize friction between the auxiliary belt 185 and the drum 110 by increasing a tension of the auxiliary belt 185, and may allow the drum 110 to be smoothly supported by the circular guides 120*a* and 120*b* and/or the auxiliary guides 140*a* and 140*b* by increasing a normal force that the auxiliary belt 185 applies to the drum 110 in an inward direction.

The idler 182 may be rotatably coupled to the cabinet 101. The rotation center of the idler 182 may vary during the rotation to actively deal with the vibration of the drum 110. The idler 182 may be connected to the cabinet 101 through an elastic member (not shown) such that the rotation center of the idler 182 varies during the rotation.

The auxiliary belt 185, as shown in FIG. 8A, may be provided in plurality. When the auxiliary belt 185 is provided in plurality, the idler 182 may also be provided in plurality. A first auxiliary belt 185*a* may support the front side of the drum 110, and a second auxiliary belt 182*b* may support the rear side of the drum 110. Thus, the drum may rotate while maintaining a cross-section of a noncircular looped curve, and the vibration due to the unbalance of the drum 110 can be inhibited. The first auxiliary belt 185*a* may receive a tension by contacting with a first idler 182*a*, and the second auxiliary belt 185*b* may receive a tension by contacting with a second idler 182*b*.

Figure 9A:
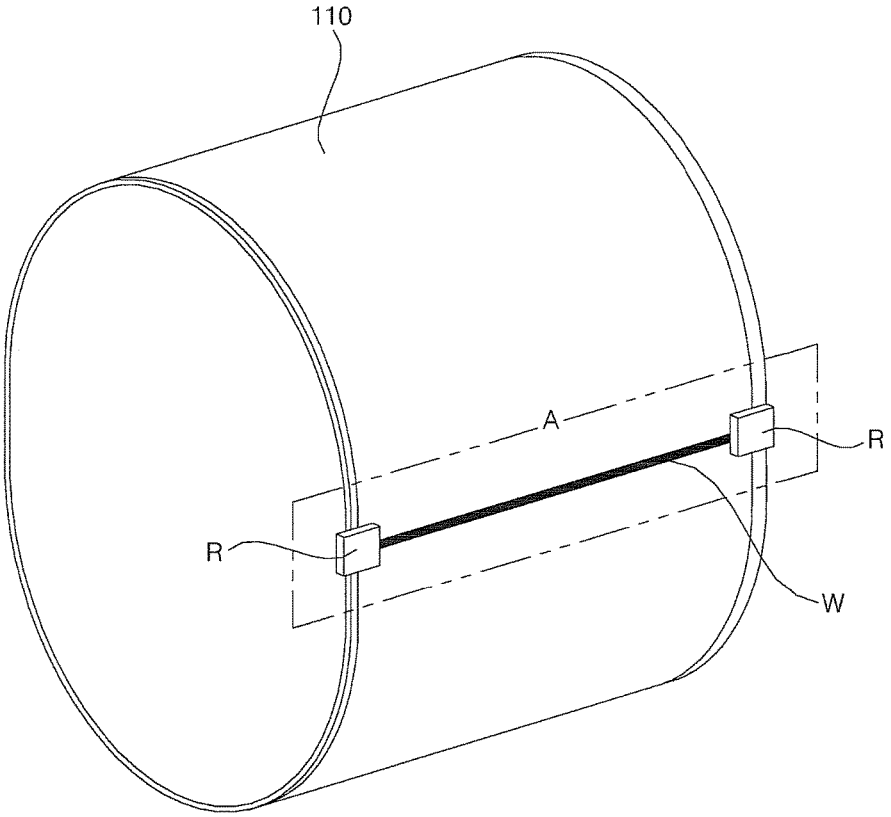
FIG. 9A is a view illustrating a drum assembly according to an embodiment of the present invention.
Figure 9B:
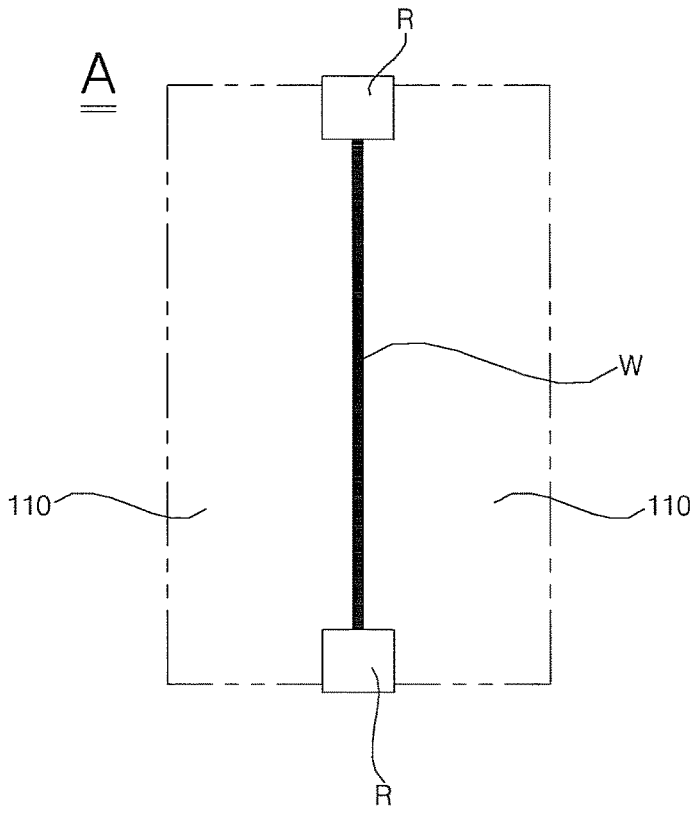
FIG. 9B is a plan view of a portion A shown in FIG. 9A.

FIG. 9A is a view illustrating a drum assembly according to an embodiment of the present invention. FIG. 9B is a plan view of a portion A shown in FIG. 9A.

Referring to FIGS. 9A and 9B, the drum assembly may include a drum 110 holding laundry and a reinforced member R provided at the edge of the front side or the rear side of the drum 110. The front side and/or the rear side of the drum 110 may be opened, and the drum 110 may be rotatably disposed to have a cross-section of a noncircular looped curve in which a distance from the rotation center of the drum 110 is not uniform.

As described above, the drum 110 may be formed to have a cross-section of a noncircular looped curve, and may be formed by welding the one edge and the other edge of a metal panel. Specifically, one edge and the other edge of a metal panel having a rectangular shape may be welded to each other to form a cylindrical shape having a cross-section of a noncircular looped curve.

A welding part W may be formed by welding the one edge and the other edge of the metal panel. The welding part W may extend from the front side to the rear side of the drum 110. The direction of the welding part W may be disposed along a junction line where the one edge and the other edge are joined to each other, and may be formed in a substantially straight line to be parallel with the rotation axis of the drum 110.

The welding part W may be formed according to various methods for welding one edge and the other edge of a metal panel. The welding part W may be formed by performing seam welding in a state where one edge partially overlaps the other edge, or by performing butt welding in a state where one edge of a metal panel is in contact with the other edge thereof. Hereinafter, it will be described that the welding part W is formed by the butt welding, but embodiments are not limited thereto. When the welding part W is formed by the butt welding, the inner surface of the drum 110 including the welding part W may be smooth.

As the drum 110 rotates while maintaining a cross-section of a noncircular looped curve, a portion of the drum 110 where the welding part W is formed may rotate while the curvature of the inner surface of the drum 110 is varying. In this case, when the welding part W of the drum 110 reaches the upper portion or lower portion of the drum 110, the curvature may become maximum. On the other hand, when the welding part W of the drum 110 reaches the left and right sides of the drum 110, the curvature may become minimum.

The inner surface of the drum 110 where the welding part W is located may vary in stress according to variation of the curvature. Due to variation of the stress, fatigue may be accumulated in the welding part W. When fatigue is accumulated beyond a certain value, the welding part W may be damaged by cracking.

In order to prevent the damage of the welding part W, the reinforced member R may be provided on the edge of the front side and/or rear side of the drum 110. The reinforced member R may enhance the strength of the welding part W and prevent growth of cracking generated in the welding part W. As the reinforced member R is provided on the welding part W, cracking may be prevented from occurring in the welding part W due to the variation of the curvature of the drum 110 that rotates while maintaining a cross-section of a noncircular looped curve, and the growth of cracking that has already occurred can be prevented.

The reinforced member R may be provided on the edge of the drum 111 where the welding part W is formed. The welding part W formed in the drum 111 may extend from the edge of the front side to the edge of the rear side of the drum 110, damage of the welding part W by fatigue may easily occur in the edge of the front and/or rear side of the drum 110 where the welding part W is formed. The welding part W formed in the edge of the front side and/or the edge of the rear side of the drum 110 may be a point on which the end of the one edge of a metal panel meets the end of the other edge thereof and stress is maximally concentrated. The reinforced member R may be provided on the edge of the front side and/or the edge of the rear side of the welding part W where stress is maximally concentrated to reinforce the strength of the welding part W.

As the reinforced member R is provided on the edge of the front side and/or the edge of the rear side of the welding part W, the strength of the edge of the welding part W that can be easily cracked can be reinforced, and thus cracking can be prevented from occurring in the welding part W.

The reinforced member R may maintain the curvature of the inner surface of the drum 110 where the welding part W is formed at a certain curvature in which cracking does not occur. Generally, the welding part W may be fused at a high temperature, and then may be rapidly cooled to be deformed into a hard material. A portion of hard material formed in the welding part W may vary in stress according to variation of the curvature, and when the curvature reaches a specific value, stress may be maximally concentrated to cause cracking such as a fracture on the welding part W. In this case, the reinforced member R provided on the welding part W may maintain the curvature at a certain value in which cracking does not occur, and prevents the curvature from reaching a specific value in which cracking occurs in the welding part W during the rotation of the drum 110.

The reinforced member R may be formed of plastic material according to embodiments. The reinforced member R may be formed of high-strength plastic material that can be finely deformed according to the varying curvature of the drum 110.

Also, the reinforced member R may include a metal material. Even when the reinforced member R includes a metal material, the reinforced member R may be finely deformed according to the varying curvature of the drum 110, and reinforced strength can significantly increase compared to the plastic material.

The reinforced member R may be implemented using a drum clip that is formed to surround both inner and outer surfaces of the drum 110. The drum clip, which is a reinforced member with one side folded, may be coupled to the drum 110 at the folded portion. The drum clip coupled to the drum 110 may simultaneously support the inner and outer surfaces of the front edge and/or the rear edge of the drum 110 to reinforce the strength of the welding part W.

Also, the reinforced member R may support only one of the edge of the inner surface and the edge of the outer surface of the drum 110. In this case, the reinforced member R may be provided on only one of the outer surface and the inner surface at a portion of the drum 110 where the welding part W is formed.

The reinforced member R may be provided on both surfaces of the drum 110. Unlike the drum clip, the reinforced member R supporting the outer surface of the drum 110 and the reinforced member R supporting the inner surface of the drum 110 may be separately formed. In this case, the reinforced member R at one side and the reinforced member at other side may be formed of different materials from each other.

The reinforced member R may be disposed inside the drum sealer 114. In other words, when the reinforced member R is provided on the edge of a portion of the drum 110 where the welding part W is formed, and the drum sealer 114 is coupled along the edge of the drum, the drum sealer 144 may be coupled to the outermost side of the edge of the drum 110 including the reinforced member R coupled to the welding part W.

Figure 10A:
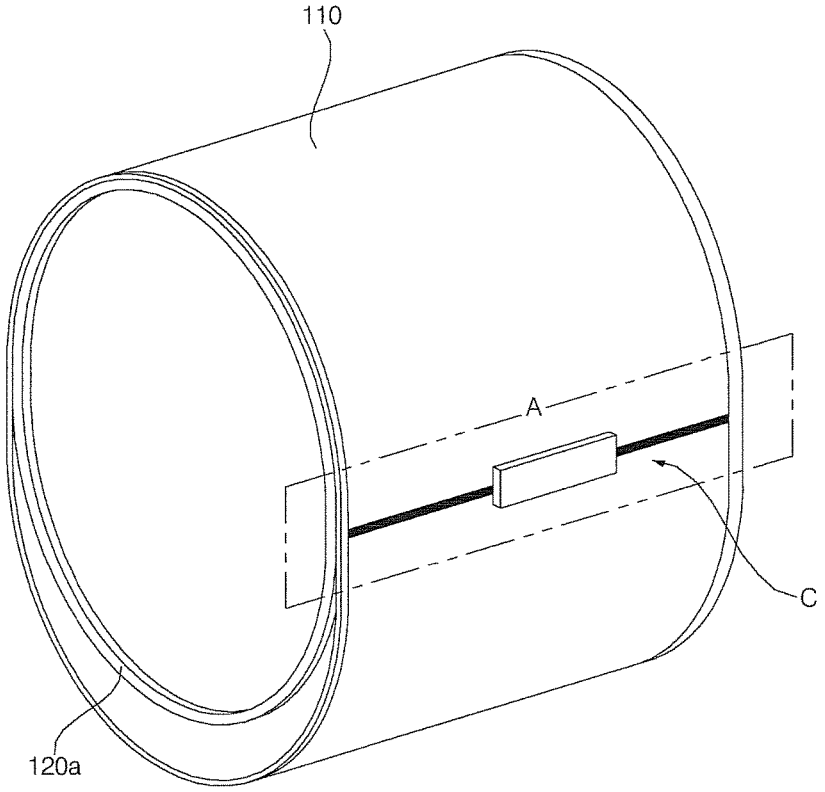
FIG. 10A is a view illustrating a drum assembly according to another embodiment of the present invention.
Figure 10B:
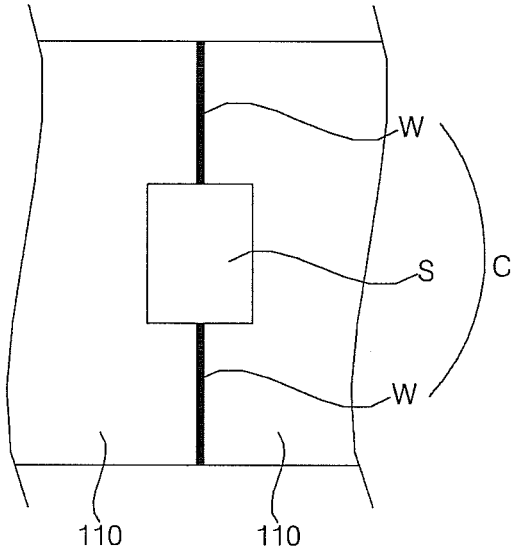
FIG. 10B is a plan view of a joining part shown in FIG. 10A.
Figure 10C:
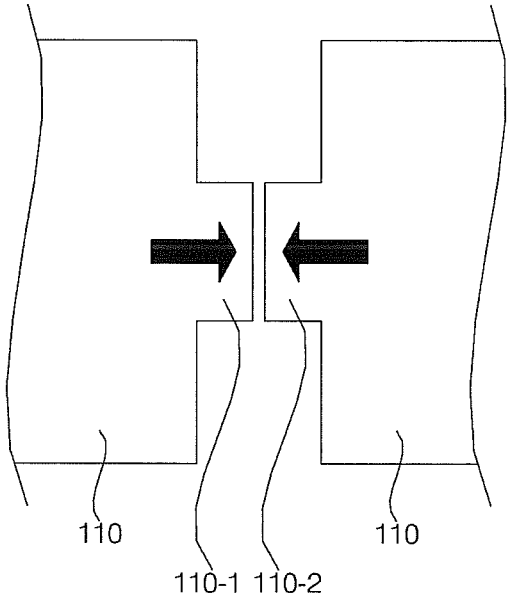
FIG. 10C is a view illustrating the joining part of FIG. 10A before joining.

FIG. 10A is a view illustrating a drum assembly according to another embodiment of the present invention. FIG. 10B is a plan view of a joining part shown in FIG. 10A. FIG. 10C is a view illustrating the joining part of FIG. 10A before joining.

Referring to FIGS. 10A through 10C, the drum assembly may include a drum 110 holding laundry and a panel provided on the front side or the rear side of the drum 110. The front side and/or the rear side of the drum 110 may be opened, and the drum 110 may be rotatably disposed to have a cross-section of a noncircular looped curve in which a distance from the rotation center of the drum 110 is not uniform. The drum 110 may include a joining part C that is formed by joining one edge with the other edge of a metal panel.

As described above, the drum 110 may be formed to have a cross-section of a noncircular looped curve, and may be formed by joining the one edge and the other edge of a metal panel. Specifically, one edge and the other edge of a metal panel having a rectangular shape may be joined to each other to form a cylindrical shape having a cross-section of a noncircular looped curve A joining part C may be formed by joining the one edge and the other edge of a metal panel. The joining part C may extend from the front side to the rear side of the drum 110. The direction of the joining part C may be disposed along a junction line where the one edge and the other edge are joined to each other, and may be formed in a substantially straight line to be parallel with the rotation axis of the drum 110.

The joining part C should have a strength corresponding to the varying curvature of the drum 110. As the drum 110 rotates while maintaining a cross-section of a noncircular looped curve, a portion of the drum 110 where the joining part C is formed may rotate while the curvature is varying. In this case, when the joining part C of the drum 110 reaches the upper portion or lower portion of the drum 110, the curvature may become maximum. On the other hand, when the joining part C of the drum 110 reaches the left and right sides of the drum 110, the curvature may become minimum.

Thus, the inner surface of the drum 110 where the joining part C is located may vary in stress according to variation of the curvature. Due to variation of the stress, fatigue may be accumulated in the joining part C. When fatigue is accumulated beyond a certain value, the joining part C may be damaged by cracking.

Joining part C has to be formed so as not to interrupt the rotation of the drum 110. In other words, the joining part C formed in a traverse direction from the front side to the rear side of the drum 110 may rotate together with the drum 110, and the circular guides 120*a* and 120*b* may be provided on the front edge and the rear edge of the drum 110. A portion of the inner surface of the drum 110 where the joining part C is formed may also contact with the circular guides 120*a* and 120*b*, and may rotate together with the drum 110. In this case, since the inner surface of the joining part C contacting with the circular guides 120*a* and 120*b* may rotate while having a varying curvature similarly to the other portions of the inner surface of the drum 110, and the inner surface of the drum 110 contacting with the circular guides 120*a* and 120*b* has to rotate together with the circular guides 120*a* and 120*b*, the joining part C should not interfere with the circular guides 120*a* and 120*b*.

When the whole of the joining part C is formed by welding such that the joining part C does not interfere with the circular guides 120*a* and 120*b*, it is possible to prevent interference with the circular guides 120*a* and 120*b*, but damage by fatigue may occur in a welded portion due to the variation of the curvature of the inner surface of the drum 110 during the rotation of the drum 110. Also, when the whole of the joining part C is formed by seaming like a typical drum, the bonding force may increase, but protrusions formed by seaming may interfere with the circular guides 120*a* and 120*b* and other components.

For this, the joining part C may include a seaming part S that is joined by seaming, and a welding part W that is joined by welding. In the seaming part S, a portion of one edge of a metal panel may be joined with a portion of the other edge of the metal panel through seaming.

The seaming part S may be formed at the central portion of the joining part C in a traverse direction from the front side to the rear side of the drum 110. The central portion may be a portion that does not contact with the circular guides 120*a* and 120*b*. The seaming part S may be formed at the central portion that does not interfere with the circular guides 120*a* and 120*b*.

As shown in FIG. 100, the seaming part S formed at the central portion may be formed by seaming folding portions 110-1 and 110-2 at one edge and folding portions 110-1 and 110-2 at the other edge. The seaming part S formed by seaming of the respective folding portions 110-1 and 110-2 may tightly join the one edge and the other edge of a metal panel to allow the joining part C not to be damaged or unfastened even when the curvature of the inner surface of the drum 110 changes during the rotation of the drum 110.

The seaming part S may be formed only on the central portion in a traverse direction from the front side to the rear side of the drum 110. The seaming part S may be formed along the traverse direction from the front side to the rear side of the drum 110 except the edge portion of the drum 110 that contacts with the circular guides 120*a* and 120*b*, and may also be formed only on the central portion that is not interfered by the circular guides 120*a* and 120*b*. Also, the seaming part S may also be formed in plurality on the central portion. Hereinafter, it will be described that the seaming part S is formed in singularity on the central portion, but embodiments are not limited thereto.

The seaming part S may be formed on the outer surface and/or the inner surface of the drum 110. The seaming part S may be protrusively formed on the outer surface of the drum 110. The seaming part S that projects outward by folding of a portion of one edge of a metal panel and a portion of the other edge of the metal panel may be formed on the outer surface of the drum to prevent interference with laundry loaded in the drum 110.

The welding part W may be formed according to various methods for welding one edge and the other edge of a metal panel. The welding part W may be formed by performing welding in a state where one edge partially overlaps the other edge, or by performing butt welding in a state where one edge of a metal panel is in contact with the other edge thereof. Hereinafter, it will be described that the welding part W is formed by the butt welding, but embodiments are not limited thereto.

When the seaming part S is formed only on the central portion, the welding part W may be formed at both side of the seaming part S. One side of the welding part W may extend from one side of the seaming part S to the front edge of the drum 110. The other side of the welding part W may extend from the other side of the seaming part S to the rear edge of the drum 110.

The welding part W extending from one side of the seaming part S may extend to one side of the edge of the drum 110 that contacts with the circular guides 120*a* and

120*b*. During the rotation of the drum 110, the drum 110 may rotate together with the circular guides 120*a* and 120*b*, or may counter-rotate to the circular guides 120*a* and 120*b*, and the inner surface of the drum 110 where the joining part C is formed may contact with the circular guides 120*a* and 120*b*. In this case, the joining part C formed in the drum 110 and the circular guides 120*a* and 120*b* contacting with the joining part C may interfere with each other during the rotation of the drum 110.

When the joining part C is formed only with the seaming part S, the inner surface of the seamed drum 110 may be caught on the circular guides 120*a* and 120*b* during the rotation of the drum 110, causing interference or a gap from the circular guides 120*a* and 120*b*. In this case, since the seamed portion and the circular guides 120*a* and 120*b* do not normally rotate, interference such as unfastening of sealing or generation of vibration may occur.

In order to prevent the joining part C from interfering with the circular guides 120*a* and 120*b*, the welding part W may be formed on the edge portion by butt welding. Since the welding part W formed by the butt welding has a smooth surface, the welding part W may not interfere with the circular guides 120*a* and 120*b*. As the welding part W is formed on the edge portion of the drum 110, the drum 110 may be prevented from interfering with the circular guides 120*a* and 120*b* provided on the edge of the drum 110 during the rotation of the drum 110.

A portion of the joining part C formed in the drum 110 may be formed with the seaming part S to increase the bonding strength of the joining part C, and the other portion of the joining part C may be formed with the welding part W to prevent interference with the circular guides 120*a* and 120*b* and simultaneously allow the curvature of the joining part C to vary according to the variation of the curvature of the inner surface of the drum 110 during the rotation of the drum 110.

Figure 11A:
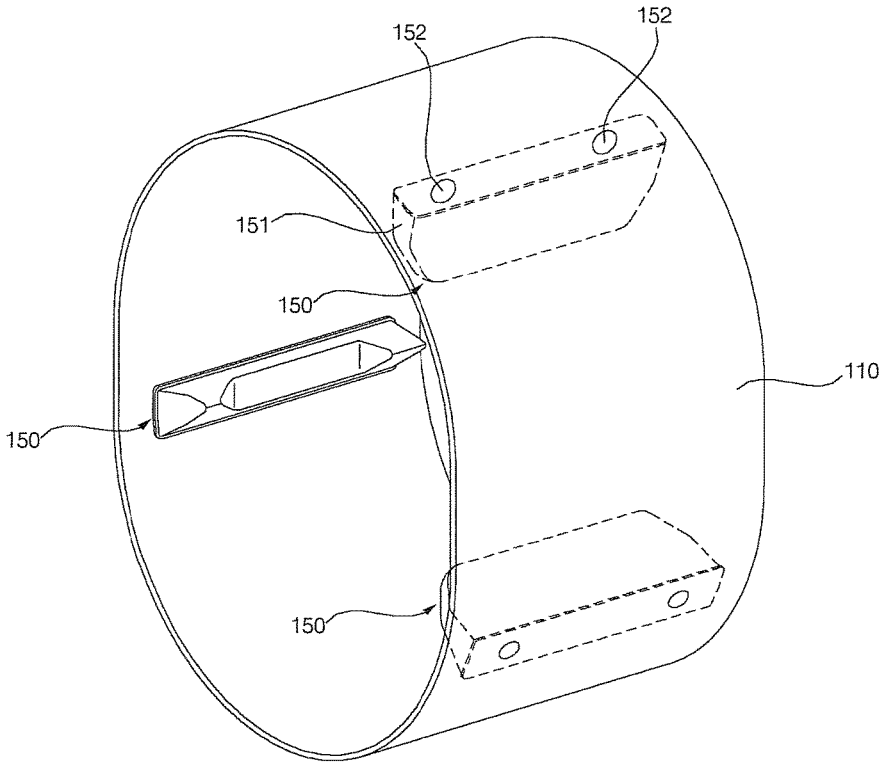
FIG. 11A is a view illustrating a drum and a lift module according to another embodiment of the present invention.

FIG. 11A is a view illustrating a drum and a lift module according to another embodiment of the present invention. FIGS. 11B through 11F are views illustrating lift modules according to various embodiments of the present invention.

Referring to FIG. 11A, a laundry treating apparatus according to an embodiment of the present invention may include a drum 110 holding laundry, a lift 151 disposed on the inner surface of the drum, and a coupling member 152. The front side and/or the rear side of the drum 110 may be opened, and the drum 110 may be rotatably disposed to have a cross-section of a noncircular looped curve in which a distance from the rotation center of the drum 110 is not uniform. The curvature of the inner surface of the drum 110 may vary during the rotation of the drum 110. The coupling member 152 may maintain the lift 151 at a substantially uniform angle with respect to the inner surface of the drum 110 regardless of the varying curvature of the inner surface of the drum 110 by penetrating the drum 110 from the outside to the inside of the drum 110.

As described above, the drum 110 may be formed to have a cross-section of a noncircular looped curve. As the drum 110 rotates while maintaining the cross-section of the noncircular looped curve, the curvature of the drum 110 may vary.

The lift 151 may be provided on the inner surface of the drum 110. The lift 151 may serve to tumble and mix laundry in the drum 110 during the rotation of the drum 110. The lift 151 may be formed of a different member from the drum 110, and may project from the inner surface of the drum 110.

Also, the lift 151 may be disposed in plurality to allow one lift 151 to tumble laundry and another lift 151 to mix laundry in the drum 110 during the rotation of the drum 110.

When the curvature of the inner surface of the drum 110 varies during the rotation of the drum 110, a gap may occur in a coupling portion between the lift 151 and the inner surface of the drum 110. The lift 151 formed with a shape corresponding to a specific curvature of the inner surface of the drum 110 may be fixed on the inner surface of the drum 110. In the case of the specific curvature, the lift 151 may be in close contact with the inner surface of the drum 110. However, in the case where the curvature of the inner surface of the drum 110 varies, a gap may occur between the lift 151 and the inner surface of the drum 110, or the lift 151 may be compressed on the inner surface of the drum 110 according to the variation of the curvature of the drum 110. For example, when the curvature of the inner surface of the drum is equal to or smaller than a specific curvature, a gap may occur between the lift 151 and the inner surface of the drum 110. Also, when the curvature of the inner surface of the drum is greater than the specific curvature, the lift 151 may excessively adhere to the inner surface of the drum 110 that is bent.

Also, when the curvature of the inner surface of the drum 110 changes, an angle between the inner surface of the drum 110 and the lift 151 may change. When the angle between the inner surface of the drum 110 and the lift 151 changes, laundry may be stuck in the gap between the lift 151 and the drum 110.

In order to prevent the above limitation, the coupling member 152 may allow the lift 151 to be maintained at a substantially uniform angle with respect to the inner surface of the drum 110. The lift 151 may be maintained at a certain angle in which laundry is not stuck between the inner surface of the drum and the lift 151 regardless of the variation of the curvature of the inner surface of the drum during the rotation of the drum 110. Thus, even when the curvature of the inner surface of the drum 110 changes, the lift 151 may be maintained at a certain angle with respect to the inner surface of the drum 110 according to the curvature variation of the inner surface of the drum 110. In this case, the certain angle between the inner surface of the drum 110 and the lift 151 may be an angle that is initially set such that laundry is not stuck between the inner surface of the drum 110 and the lift 151. The coupling member 152 may allow the lift 151 to be maintained at a substantially uniform angle with respect to the inner surface of the drum 110 during the rotation of the drum 110.

The coupling member 152 may fix the lift 151 such that the lift 151 projects in a normal direction from the inner surface of the drum 110. The lift 151 may project in the normal direction from the inner surface of the drum 110, and may be substantially perpendicular to the inner surface of the drum 110. An angle between the inner surface of the drum 110 and the lift 151 may be about 90 degrees, but embodiments are not limited thereto.

The coupling member 152 and the lift 151 may form one lift module 150. Specifically, the lift 151 provided on the inner surface of the drum 110 and the coupling member 152 for fixing the lift 151 on the drum 110 may form one lift module 150, which may vary according to the curvature variation of the inner surface of the drum 110 during the rotation of the drum. The coupling member 152 of the varying lift module 150 may prevent laundry from being stuck between the inner surface of the drum 110 and the lift 151, by allowing the lift 151 to be maintained at a uniform angle with respect to the inner surface of the drum 110.

Figure 11B:
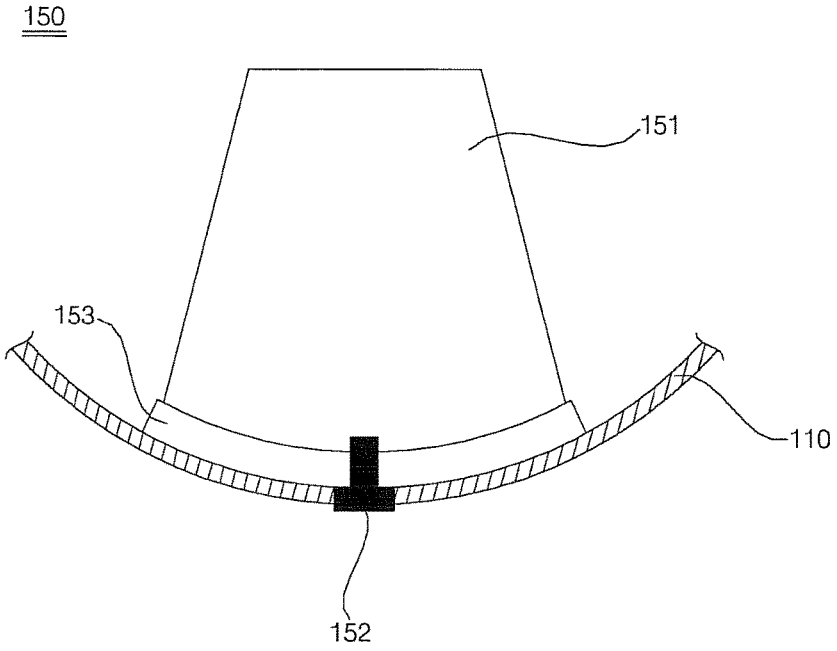
FIGS. 11B through 11F are views illustrating lift modules according to various embodiments of the present invention.

Hereinafter, the lift module 150 will be described in more detail with reference to FIG. 11B. The coupling member 152 may be coupled to the lift 151 by penetrating the drum 110 from the outside to the inside. In this case, the coupling member 152 may include screw, bolt, and nail, but embodiments are not limited thereto. Also, the coupling member 152 may penetrate the drum 110 from the inside to the outside, and then a member such as nut for fixing the coupling member 152 may be provided on the outside of the drum 110. Hereinafter, it will be described that the coupling member 152 penetrates the drum from the outside to the inside to fix the lift 151, but embodiments are not limited thereto.

When the coupling member 152 is coupled to the lift 151, the coupling member 152 may fix the lift 151 such that the lift 151 is maintained at a certain angle with respect to the inner surface of the drum 110. The angle between the lift 151 and the drum 110 may be finely changed by the curvature variation of the inner surface of the drum 110 during the rotation of the drum 110. In this case, the coupling member 152 may maintain a substantially uniform angle between the lift 151 and the inner surface of the drum 110 to prevent a gap from occurring therebetween.

An elastic member 153 may be further disposed between the lift 151 and the inner surface of the drum 110. The elastic member 153 may be fixed on the inner surface of the drum 110, and may be penetrated by the coupling member 152. The elastic member 153 may be formed of an elastic material to prevent a gap from occurring between the inner surface of the drum 110 and the lift 151 according to the varying curvature during the rotation of the drum 110.

Specifically, when the angle between the lift 151 and the inner surface of the drum 110 deviates from a certain angle or shows a slight difference from the certain angle due to the curvature variation of the inner surface of the drum 110, the elastic member 153 may elastically change between the inner surface of the drum 110 and the lift 151 to prevent a gap from occurring between the lift 151 and the inner surface of the drum 110 and maintain the certain angle between the lift 151 and the inner surface of the drum 110 at a substantially uniform angle.

The elastic member 153 may be formed of a rubber pad having elasticity, or a highly-polymerized compound having elasticity. Hereinafter, it will be described that the elastic member 153 is implemented with a rubber pad, but embodiments are not limited thereto.

Figure 11C:
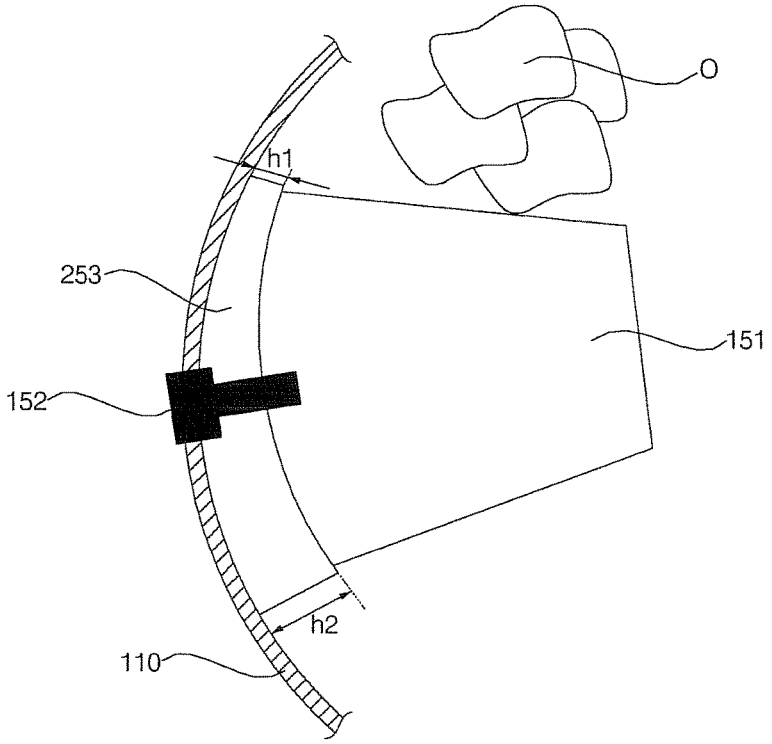

An elastic member 253 according to another embodiment will be described with reference to FIG. 11C. The elastic member 253 may have a thickness h1 and a thickness h2 different from each other at one side and the other side thereof. As the elastic member 253 has different thicknesses h1 and h2, the cross-section of the elastic member 253 may have a trapezoidal shape, and may be tapered.

The tapered shape of the elastic member 253 may support the lower portion of the lift 151 such that the lift 151 is maintained at a substantially uniform angle with respect to the varying curvature of the inner surface of the drum 110 when the drum rotates in only one direction of clockwise direction and counter-clockwise direction.

When the lift 151 lifts laundry during the rotation of the drum 110, the thickness h1 of one side of the elastic member 253 supporting one side of the lift 151 that lifts laundry may be thinner than the thickness h2 of the other side of the tapered shape. As shown in FIG. 11C, since one side of the lift 151 that lifts laundry may be subjected to the load of laundry, the one side of the lift 151 may easily become apart from the inner surface of the drum, and the other side of the lift 151 may be bent toward the inner surface of the drum 110.

In this case, in order to maintain a certain angle between the inner surface of the drum 110 and the lift 151, the thickness h1 of the one side of the elastic member 253 supporting the one side of the lift 151 that lifts laundry may be formed thinner than the thickness h2 thereof to minimize a gap between the lift 151 and the inner surface of the drum 110.

Also, the thickness h2 of the other side of the elastic member 253 supporting the other side of the lift 151 may be formed thicker than the thickness h1 of the one side to support a force applied to the other side of the lift 151 and thus prevent the other side of the lift 151 from being bent toward the inner surface of the drum 110.

Figure 11D:
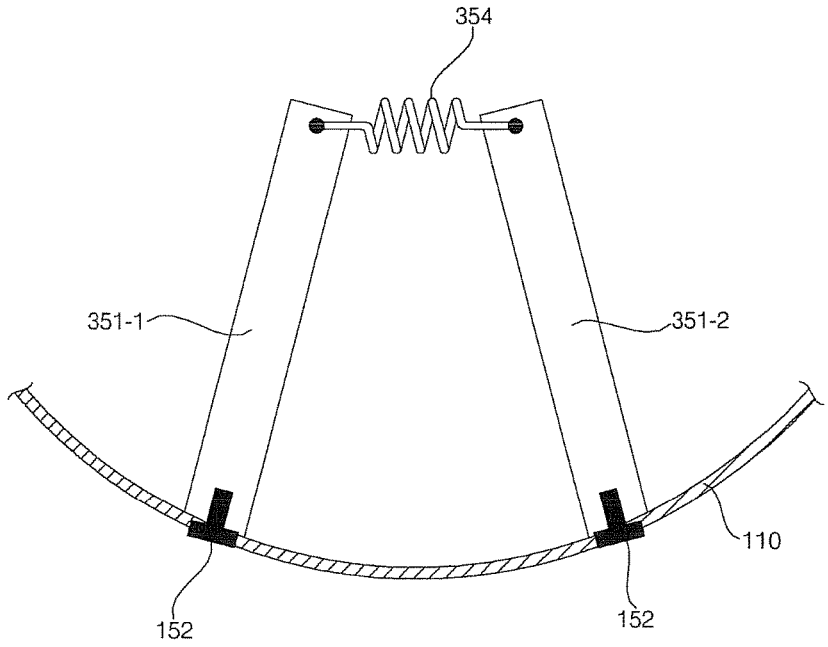

Referring to another embodiment of a lift module 150 shown in FIG. 11D, the lift 151 may include a first lift 351-1 fixed on the inner surface of the drum 110, a second lift 351-2 fixed on the inner surface of the drum 110 and spaced from the first lift 351-1, and an elastic connection body 354 disposed between the first lift 351-1 and the second lift 351-2 and controlling a distance between the first lift 351-1 and the second lift 351-2 during the rotation of the drum 110.

The first lift 351-1 and the second lift 351-2 may be fixedly disposed on the inner surface of the drum 110. The first lift 351-1 and the second lift 351-2 may be fixed by a coupling member 152. In this case, the coupling member 152 may be provided in plurality, and each of the coupling members 152 may be coupled to the first lift 351-1 and the second lift 351-2, respectively, to allow the first lift 351-1 and the second lift 351-2 to be substantially maintained at a certain angle with respect to the inner surface of the drum 110. When the coupling member 152 fixes the first lift 351-1 and the second lift 351-2 on the inner surface of the drum 110, the first lift 351-1 or the second lift 351-2 may be allowed to be maintained at a substantially uniform angle with respect to the inner surface of the drum 110 during the rotation of the drum 110.

The elastic connection body 354 may be disposed between the first lift 351-1 and the second lift 351-2. The elastic connection body 354 may be disposed between the end of the first lift 351-1 and the end of the second lift 351-2 such that the end of the first lift 351-1 can be connected to the end of the second lift 351-2.

The elastic connection body 354 may be formed of an elastic material that can vary in length. The elastic connection body 354 may be elastically changed to control the distance between the first lift 351-1 and the second lift 351-2. When the drum 110 rotates, the first lift 351-1 and the second lift 351-2 may become substantially perpendicular to the inner surface of the drum 110, and thus the distance between the end of the first lift 351-1 and the end of the second lift 351-2 may vary due to the curvature variation of the inner surface of the drum 110 between the first lift 351-1 and the second lift 351-2.

When the curvature of the inner surface of the drum 110 becomes about zero during the rotation of the drum 110, the first lift 351-1 and the second lift 351-2 may become parallel to each other or may become close thereto, and the distance between the first lift 351-1 and the second lift 351-2 may become maximum. In this case, the length of the elastic connection body 354 may increase, and thus the distance between the first lift 351-1 and the second lift 351-2 may be controlled.

On the other hand, at a point where the curvature of the inner surface of the drum 110 is maximum, since the distance between the end of the first lift 351-1 and the end of the second lift 351-2 becomes minimum, the length of the elastic connection body 354 may be reduced, and thus the distance between the first lift 351-1 and the second lift 351-2 may be controlled.

Figure 11E:
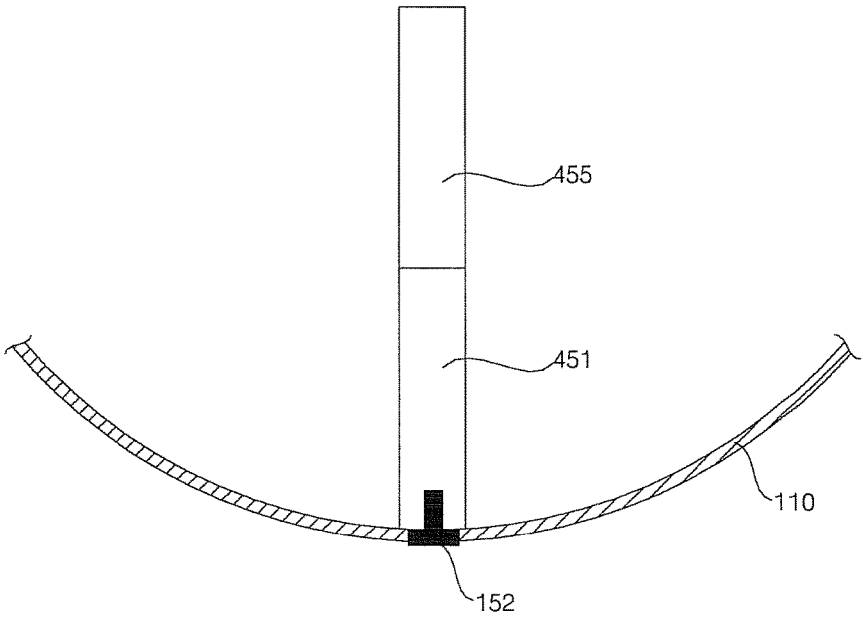

Referring to another embodiment of a lift module 150 shown in FIG. 11E, the both surfaces of a lift 451 may be formed substantially parallel to each other. The both surface of the lift 451 may be formed parallel to each other, and the sectional shape of the lift 451 may not be tapered. The lift 451 may be formed relatively thinner. The lift 451 may be formed to have such a thickness that a coupling member 152 can be coupled. The lift 451 may have a thickness corresponding to the diameter of the coupling member 152.

An elastic lift 455 formed of an elastic material may be provided on one end of the lift 451. The elastic lift 455 may lift laundry during to rotation of the drum 110, and may be elastically bent to prevent the lift 451 from being unfastened from the drum 110 when the lift 451 may be unfastened from the drum 110 due to an excessive load of laundry.

Figure 11F:
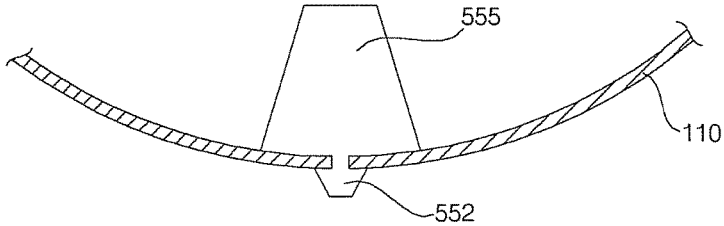

FIG. 11F is a cross-sectional view of a lift module 150 according to another embodiment of the present invention.

Referring to FIG. 11F, the lift module 150 may include a lift 555 provided on the inner surface of the drum 110 and a coupling member 552 for fixing the lift 555 on the drum 110.

The coupling member 552 may include a hook that projects from the lift 555. The hook may be formed integrally with the lift 555, and may be press-fitted into a hook hole formed in the drum 110. When the hook is press-fitted into the hook hole, the lift 555 may be fixed on the inner surface of the drum 110 in the normal direction to the inner surface of the drum 110. As describe above, the coupling member 552 may allow the lift 555 to be fixed while maintaining a substantially uniform angle with respect to the inner surface of the drum 110 according to the curvature variation of the drum 110. As the coupling member 552 may be integrally coupled to the lift 555, an additional coupling member is not needed when the drum 110 and the lift 555 are coupled to each other. Accordingly, the work effort can be saved.

Figure 12A:
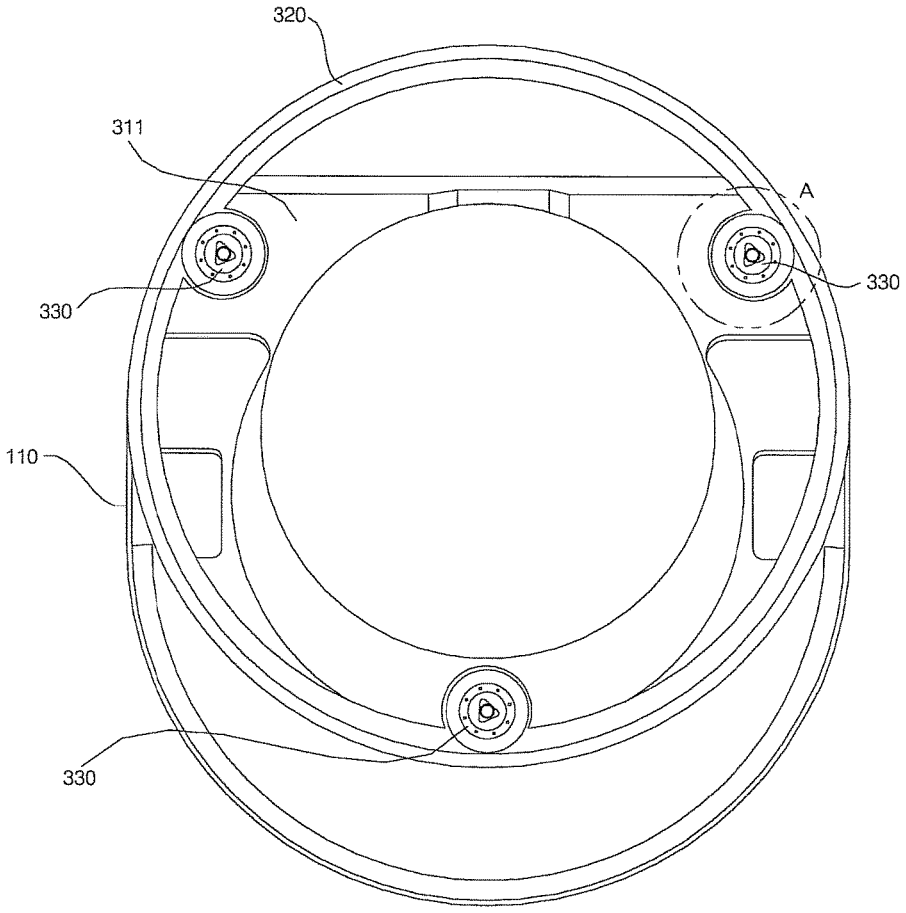
FIG. 12A is a view illustrating a circular guide and a panel according to another embodiment of the present invention.
Figure 12B:
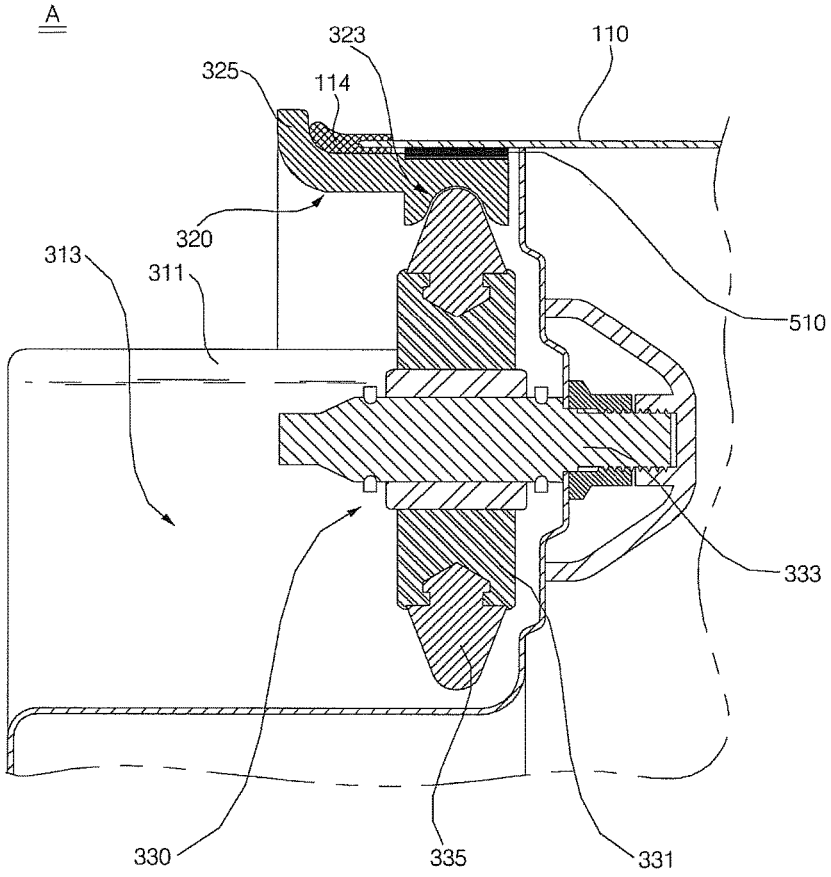
FIG. 12B is a cross-sectional view illustrating a portion A shown in FIG. 12A.

FIG. 12A is a view illustrating a circular guide 320 and a panel according to another embodiment of the present invention. FIG. 12B is a cross-sectional view illustrating a portion A shown in FIG. 12A.

Referring to FIGS. 12A and 12B, a laundry treating apparatus according to another embodiment of the present invention may include a drum 110 holding laundry, a circular guide 320 rotatably supporting a portion of the drum 110 where the section curvature is uniform, a panel 311 provided on the front side or the rear side of the drum 110, and a rolling member 330 disposed between the circular guide 320 and the panel 311 and supporting the circular guide 320. The front side and/or the rear side of the drum 110 may be opened, and the drum 110 may be rotatably disposed to have a cross-section of a noncircular looped curve in which a distance from the rotation center of the drum 110 is not uniform. Hereinafter, a detailed description of the drum 110 and the circular guide 320 described above will be omitted or focused on a difference between embodiments.

The panel 311 may support the circular guide 320 of the drum 110. The panel 311 may be provided on the front side of the drum 110 as a front panel 311, and may be provided on the rear side of the drum as a rear panel (not shown). The front panel 311 and/or the rear panel may be fixedly provided in a cabinet. The panel 311 shown in FIGS. 12A and 12B may represent the front panel 311, but may also be applied to the rear panel. Hereinafter, it will be described that the panel 311 is the front panel 311.

The panel 311 may support the circular guide 320 such that the circular guide 320 rotates. The panel 311 may be coupled to the cabinet to support the circular guide 320 supporting the load of the drum 110. As described above, a panel loading hole may be provided in the front panel 311, and an intake duct (not shown) may be provided in the front panel.

A rolling member 330 may be provided between the circular guide 320 and the panel 311. The rolling member 330 may support the inner surface of the circular guide 320 when the circular guide rotates. The rolling member 330 may support the load of the drum 110 applied to the circular guide 320 and the load of the circular guide 320, and may support the rotation of the circular guide 320 during the rotation of the drum 110.

The rolling member 330 may be rotatably provided in the panel 311. The rolling member 330 may include a roller, a ball, and the like. When the rolling member 330 is implemented with a roller, the rotation axis of the rolling member 330 may be fixedly coupled to the panel 311 to allow the rolling member 330 to rotate on one point of the panel 311.

The rolling member 330 may include a rotation member 331 counter-rotating to the circular guide 320 and a shaft 333 fixedly coupled to the panel 311 by penetrating through the rotation member 331. In this case, the shaft 333 may form the rotation axis of the rotation member 331, and the rotation member 331 may counter-rotate to the circular guide 320 on the shaft 333.

The rolling member 330 may support the circular guide 320, and may allow the circular guide 320 to counter-rotate to the panel during the rotation of the drum 110. When the circular guide is coupled to the inner surface of the drum 110 to rotate together with the drum 110 or rotate with a slight difference from the drum 110, the rolling member 330 may counter-rotate the circular guide 320 in the panel 311. As the rolling member 330 is provided between the circular guide 320 and the panel 311 such that the rolling member 330 supports the circular guide 320 and simultaneously rotates the circular guide 320 in the panel 311, the circular guide 320 may rotate together with the drum 110 during the rotation of the drum 110.

In a state where the outer surface 335 of the rolling member 330 is in contact with the inner surface of the circular guide 320, the circular guide 320 may counter-rotate. The rotation axis of the rolling member 330 may be fixedly coupled to the panel 311 to allow the rolling member 330 to rotate in the panel 311, and the inner surface of the circular guide 320 may contact with the outer surface 335 of the rolling member 330 to counter-rotate to the rolling member 330 during the rotation of the circular guide 320.

A rolling member insertion groove 323 may be formed in the inner surface of the circular guide 320. The rolling member insertion groove 323 may be formed such that the outer surface 335 of the rolling member 330 can be inserted into the rolling member insertion groove 323. The rolling member insertion groove 323 may prevent the circular guide 320 from escaping from the rolling member 330 due to vibration generated during the relative motion between the rolling member 330 and the circular guide 320.

The outer surface 335 of the rolling member 330 may be formed of a material having a high friction coefficient such that the counter-rotation between the rolling member 330 and the circular guide 320 can be easily achieved. The outer surface 335 of the rolling member 330 may be formed of a rubber material having a high friction coefficient such that a slip does not occur when the circular guide 320 counter-rotates between the inner surface of the circular guide 320 and the outer surface of the rolling member 330. The outer surface 335 of the rolling member 330 according to an embodiment of the present invention may be formed of a rubber material having a high friction coefficient, but embodiments are not limited thereto. Since the outer surface 335 of the rolling member 330 is formed of a rubber material having a high friction coefficient, a slip between the circular guide 320 and the rolling member 330 may be prevented.

The rolling member 330 may be provided in plurality in the panel 311. The rolling member 330 may be provided in plurality along the rim of the panel 311, and may be disposed along the rim of the panel 311 to contact with the inner surface of the circular guide 320.

At least one rolling member 330 may be provided on the upper rim of the panel 311 to support the load of the circular guide 320. The rolling member 330 provided on the upper rim of the panel 311 may be greatly subjected to the load of the circular guide 320. The load of the circular guide 320 may be concentrated along the upper rim of the panel 311.

In order to support the load of the circular guide 320, at least one rolling member 330 may be provided on the upper rim of the panel 311 to support the circular guide 320. It will be described in this embodiment that two rolling members 330 are provided on the upper rim of the panel 311, each being provided on one side and the other side of the upper rim of the panel 311, respectively, but embodiments are not limited thereto.

The rolling member 330 may be provided in plurality on the upper side based on a horizontal line crossing the center of the circular guide 320. The horizontal line crossing the center of the circular guide 320 may be an extension line of a diameter crossing the geometrical center of the circular guide 320. The rolling member 330 may be provided in plurality on the upper rim of the panel across the horizontal line.

As at least one rolling member 330 is provided on the upper rim of the panel 311, the load of the circular guide 320 can be evenly supported, and the circular guide 320 can smoothly rotate.

Also, the rolling member 330 may be provided in plurality on the central portion of the lower rim of the panel 311. The rolling member 330 may be provided on the lower rim, preferably, the central portion of the lower rim of the panel 311. The load of the circular guide 320 may not be applied to the central portion of the lower rim of the panel 311, or may be slightly applied to the central portion of the lower rim of the panel 311. Accordingly, the rolling member 330 disposed on the lower rim of the panel 311 may serve to facilitate the counter-rotation of the circular guide 320, and the rolling member 330 disposed on the central portion of the lower rim of the panel 311 to which the load of the circular guide 320 is scarcely applied may intensively serve to facilitate the counter-rotation of the circular guide 320.

As shown in FIG. 12B, the rolling member 330 may be provided in a rolling member seating part 313. The rolling member seating part 313 may be recessed such that the rolling member 330 is seated in the panel 311. The rolling member seating part 313 may support the rolling member 330 such that the rolling member 330 is not separated from the panel 311.

Unlike the embodiment of FIG. 4B, a drum protector 325 may be formed on one side of the circular guide 320 to cover the edge of the drum 110. The drum protector 325 may extend from one side of the circular guide 320. The drum protector 325 may be formed integrally with the circular guide 320, and may be bent to cover the edge of the drum 110. Since the drum protector 325 may be formed to have a diameter greater than the edge of the drum 110, the drum protector 325 may project upward compared to the edge of the drum 110.

The drum protector 325 formed integrally with the circular guide 320 may prevent the drum 110 from being separated from the circular guide 320 in the forward or backward direction due to vibration generated during the rotation of the drum, by covering and supporting the edge of the drum 110.

A pad 510 shown in FIG. 12B may be further provided between the drum 110 and the circular guide 320. The pad 510 may be fixed on the inner surface of the drum 110, and may seal a gap between the drum 110 and the circular guide 320.

Figure 13A:
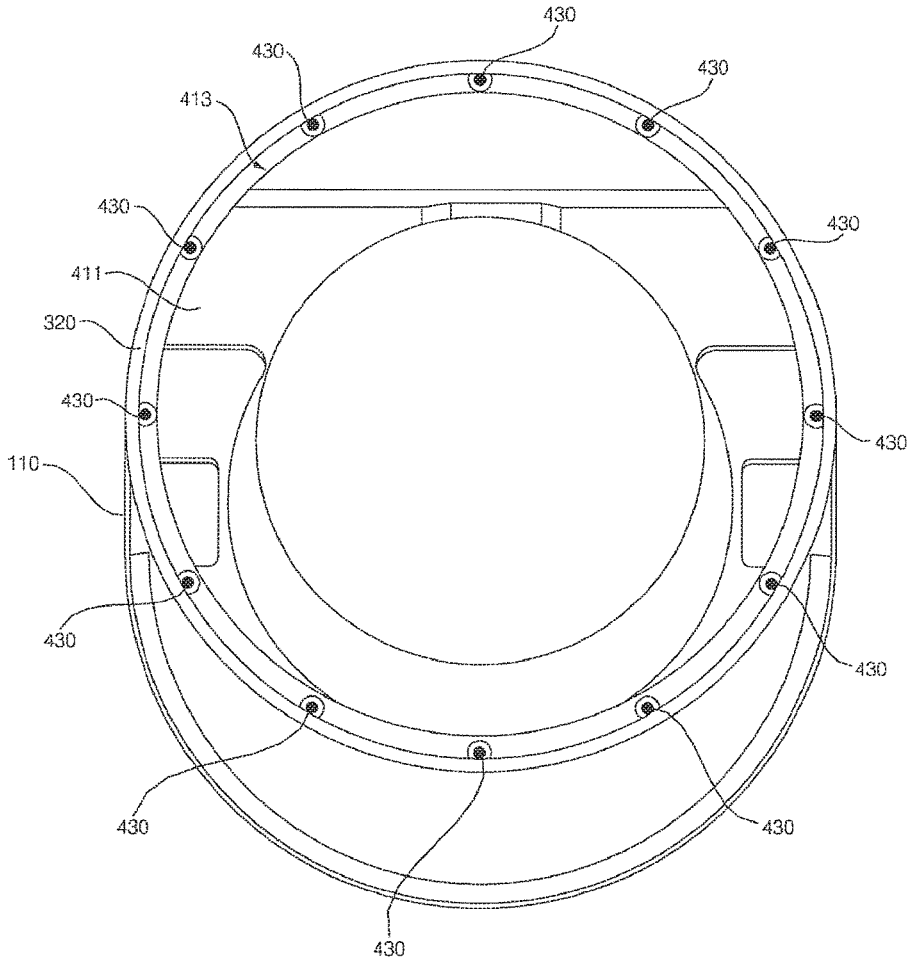
FIG. 13A is a view illustrating a rolling member and a panel according to another embodiment of the present invention.
Figure 13B:
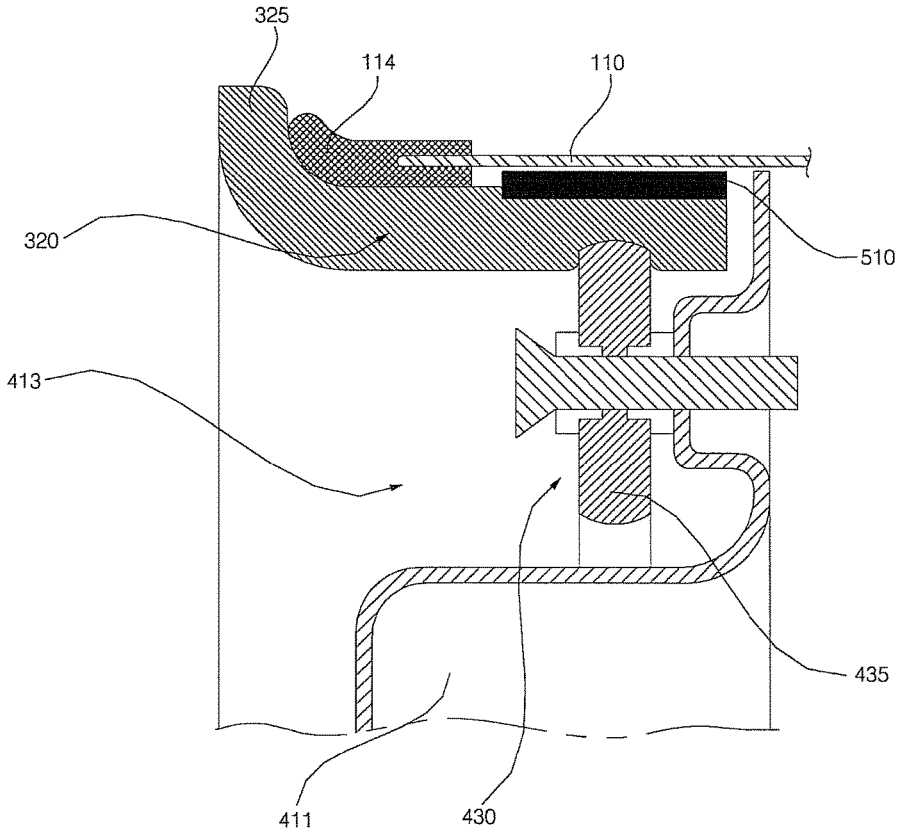
FIG. 13B is a cross-sectional view illustrating a portion B shown in FIG. 13A.

FIG. 13A is a view illustrating a rolling member and a panel according to another embodiment of the present invention. FIG. 13B is a cross-sectional view illustrating a portion B shown in FIG. 13A.

Referring to FIGS. 13A and 13B, a rolling member seating part 413 according to another embodiment of the present invention may be disposed in plurality along the rim of the panel 411. When the rolling member seating part 413 is formed in plurality, a plurality of rolling member 430 may be provided in each of the rolling member seating part 413. The rolling member seating part 413 may be spaced from each other along the rim of the panel 411.

The rolling member seating part 413 may be spaced from each other by a certain distance, and may be evenly disposed over the rim of the panel 411. A rolling member 430 may be rotatably provided in the rolling member seating part 413, respectively, to support the load of the circular guide 320. Since the rolling member 430 is disposed in the rolling member seating part 413 along the rim of the panel 411 at a certain interval, the rolling member 430 may evenly support the load of the circular guide 320.

Also, the rolling member seating part 413 may be integrally and continuously recessed along the rim of the panel 411. In this case, the rolling member 430 may be provided in plurality in the rolling member seating part 413, and may be spaced from each other by a certain distance. It has been described in FIGS. 13A and 13B that the rolling member seating part 413 is continuously recessed and integrally formed along the rim of the panel 411, but embodiments are not limited thereto. When the rolling member seating part 413 is integrally recessed along the rim of the panel 411, the work effort for forming the panel 411 can be saved to reduce the work time and cost.

Figure 14A:
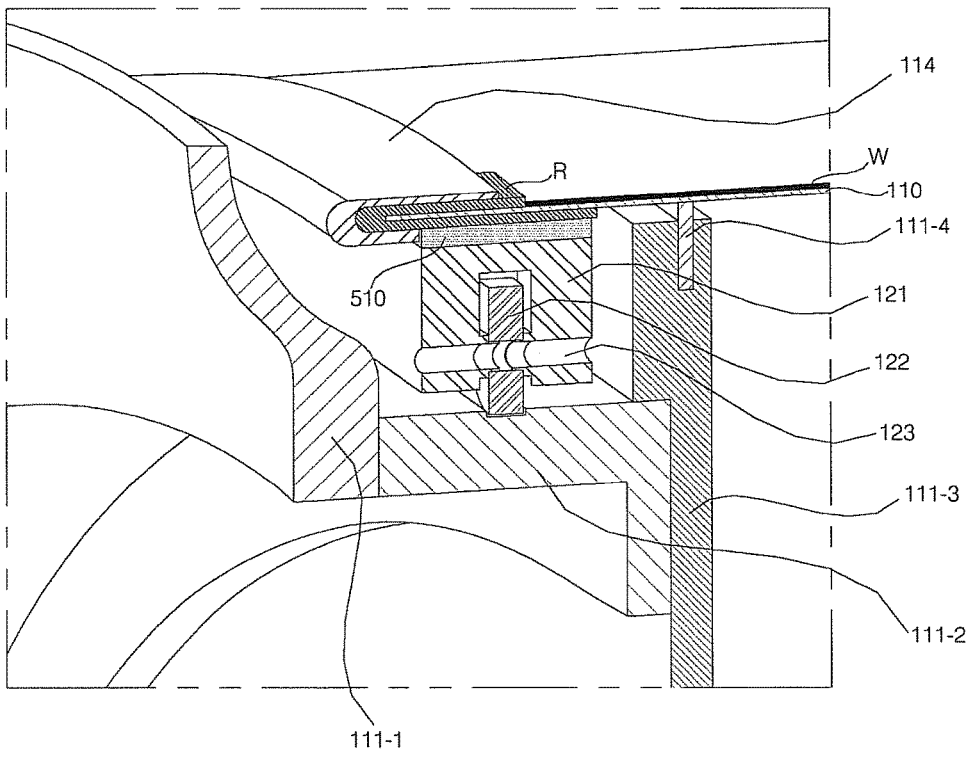
FIG. 14A is a view illustrating a configuration shown in FIG. 4B according to another embodiment of the present invention.

FIG. 14A is a view illustrating a configuration shown in FIG. 4B according to another embodiment of the present invention.

Referring to FIG. 14A, a laundry treating apparatus according to another embodiment of the present invention may include a drum 110 holding laundry, circular guides 120*a* and 120*b* rotatably supporting a portion of the drum 110 where the section curvature is uniform, and a pad 510 disposed between the drum and the circular guides 120*a* and 120*b*, rotating together with the drum 110, and reducing noise and vibration generated by friction between the drum 110 and the circular guides 120*a* and 120*b*. The front side and/or the rear side of the drum 110 may be opened, and the drum 110 may be rotatably disposed to have a cross-section of a noncircular looped curve in which a distance from the rotation center of the drum 110 is not uniform. Hereinafter, only parts other than components shown in FIG. 4B will be described in detail, and unexplained reference numerals will be substituted with those of FIG. 4*b*.

As described above, the drum sealer 114 may be provided on the edge of the drum 110. The reinforced member R as described above may be further provided on an edge portion of the drum 110 to which the drum sealer 114 is coupled. The drum sealer 114 may cover the reinforced member R at the edge portion of the drum 110. In this case, the reinforced member R may be press-fitted into the drum sealer 114.

The pad 510 may be provided between the drum 110 and the circular guides 120*a* and 120*b*. The pad 510 may be fixedly disposed on the inner surface of the drum 110 along the edge of the drum 110, or may be fixed disposed along the outer surface of the circular guides 120*a* and 120*b*. Hereinafter, it will be described that the pad 510 is fixedly disposed along the inner surface of the drum 110, but embodiments are not limited thereto. For example, the pad 510 may be fixed on the circular guides 120*a* and 120*b*, or may be neither fixed on the outer surface of the circular guides 120*a* and 120*b* nor the inner surface of the drum 110.

When the pad 510 is provided along the edge of the drum 110, as shown in FIG. 14A, a portion of the pad 510 may interfere with the reinforced member R. Specifically, when the pad 510 is formed to have a rim shape along the inner surface of the edge of the drum 110, the pad 510 may interfere with the reinforced member R provided on a portion of the edge of the drum 110 to cover the reinforced member R. It has been described in FIG. 14A that the pad 510 may be provided on the edge of the drum provided with the reinforced member R, but the pad 510 may be provided on a portion of the drum 110 that is not provided with the reinforced member R. In this case, the description of the pad 510 can be totally applied thereto.

The pad 510 may rotate together with the drum 110 during the rotation of the drum 110. When the drum 110 rotates, the pad 510 provided between the drum 110 and the circular guides 120*a* and 120*b* may rotate together with the drum 110. In this case, the pad 510 may rotate at the same angular speed as the drum 110, or may rotate while causing a slip with the drum 110. Also, even when the circular guides 120*a* and 120*b* rotate due to the rotation of the drum 110, the pad 510 may rotate together with the drum 110 and/or the circular guides 120*a* and 120*b*.

The pad 510 may reduce noise generated by friction between the circular guides 120*a* and 120*b* and the drum 110. When there are a friction between the drum 110 and the circular guides 120*a* and 120*b* and a slip between the drum 110 and the circular guides 120*a* and 120*b*, noise may be generated due to the friction between the drum 110 and the circular guides 120*a* and 120*b*. In this case, the pad 510 may be provided between the drum 110 and the circular guides 120*a* and 120*b* to absorb noise generated between the drum 110 and the circular guides 120*a* and 120*b*.

Also, mechanical vibration may occur due to the friction between the circular guides 120*a* and 120*b* and the drum 110. In turn, the vibration may vibrate the surface of the drum 110, and may interrupt the rotation of the drum 110 and generate noise due to the mechanical vibration on the surface of the drum 110. In this case, since the pad 510 is provided between the drum 110 and the circular guides 120*a* and 120*b*, the vibration generated between the drum 110 and the circular guides 120*a* and 120*b* can be absorbed.

One surface of the pad 510 may contact with the circular guides 120*a* and 120*b*, and the other surface of the pad 510 may contact with the inner surface of the drum 110 and the reinforced member R. When the pad 510 is fixed on the circular guides 120*a* and 120*b*, a slip may occur between the inner surface of the drum 110 and the pad 510. Also, when the pad 510 is fixed on the inner surface of the drum 110, a slip may occur between the circular guides 120*a* and 120*b* and the pad 510. Also, when the pad is provided but not fixed between the circular guides 120*a* and 120*b* and the drum 110, a slip may occur between the drum 110 and the pad 510 and between the circular guides 120*a* and 120*b* and the pad 510. Hereinafter, it will be described that the pad 510 is fixedly provided on the inner surface of the drum 110 and a slip occurs between the pad 510 and the circular guides 120*a* and 120*b*, but embodiments are not limited thereto.

The pad 510 may be formed of a material having a high friction coefficient such that a slip does not occur between the pad 510 and the circular guides 120*a* and 120*b*. The pad 510 may be formed of a fabric material having a high friction coefficient, or may be formed of a silicone material having a high friction coefficient. Also, the pad 510 may include a typical rubber material. Hereinafter, it will be described that the pad 510 is formed of a rubber material, but embodiments are not limited thereto. Since the pad 510 is formed of a material having a high friction coefficient, a slip may be prevented from occurring between the pad 510 and the drum 110 or the circular guides 120*a* and 120*b*.

The pad 510 may be formed of an elastic material. A portion of the load of the drum 110 may be delivered to the pad 510 during the rotation of the drum 110, and thus the pad 510 may be compressed between the drum 110 and the circular guides 120*a* and 120*b* by the load of the drum 110. In this case, since the pad 510 is formed of an elastic material, and may be compressed between the circular guides 120*a* and 120*b* and the drum 110 by the load of the drum 110, the pad 510 can seal a gap between the drum 110 and the circular guides 120*a* and the 120*b*.

The pad 510 may reduce noise generated in a portion that the auxiliary guide supports. A portion of the inner surface of the drum 110 that is not supported by the circular guides 120*a* and 120*b* may be supported by the auxiliary guide described above, and may contact with the auxiliary guide because the pad 510 is provided along the inner surface of the edge of the drum. In this case, the pad 510 may be disposed between the drum 110 and the auxiliary guide instead of the circular guides 120*a* and 120*b*. Similarly to the circular guides 120*a* and 120*b*, noise and/or vibration may occur during the rotation of the drum 110. The pad 510 may prevent noise or vibration generated in a portion that is supported by the auxiliary guide.

Figure 14B:
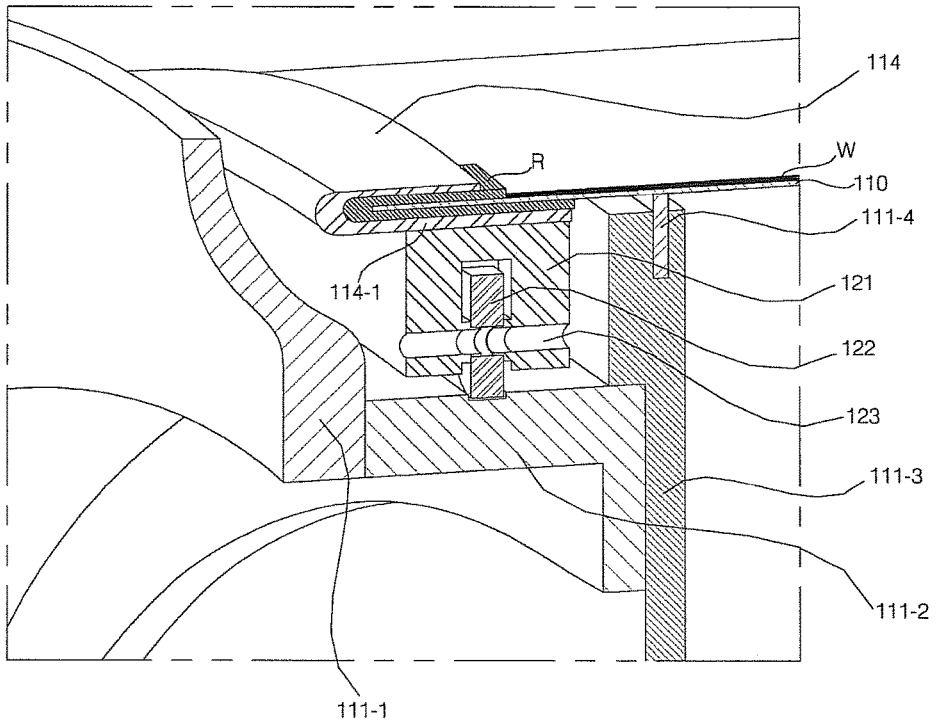
FIG. 14B is a view illustrating a configuration shown in FIG. 14A according to another embodiment of the present invention.

FIG. 14B is a view illustrating a configuration shown in FIG. 14A according to another embodiment of the present invention.

Referring to FIG. 14B, the pad 510 may extend from the drum sealer 114, and an extending portion may serve as a pad 114-1. The pad 510 may be formed of a material similar to that of the drum sealer 114, and the extending portion of the drum sealer 114 serving as the pad 114-1 may be provided between the circular guides 120*a* and 120*b* and the drum 110.

As described above, the extending portion of the drum sealer 114 may rotate together with the drum 110 during the rotation of the drum 110 to reduce noise or vibration generated by friction between the drum 110 and the circular guides 120*a* and 120*b*.

Figure 15A:
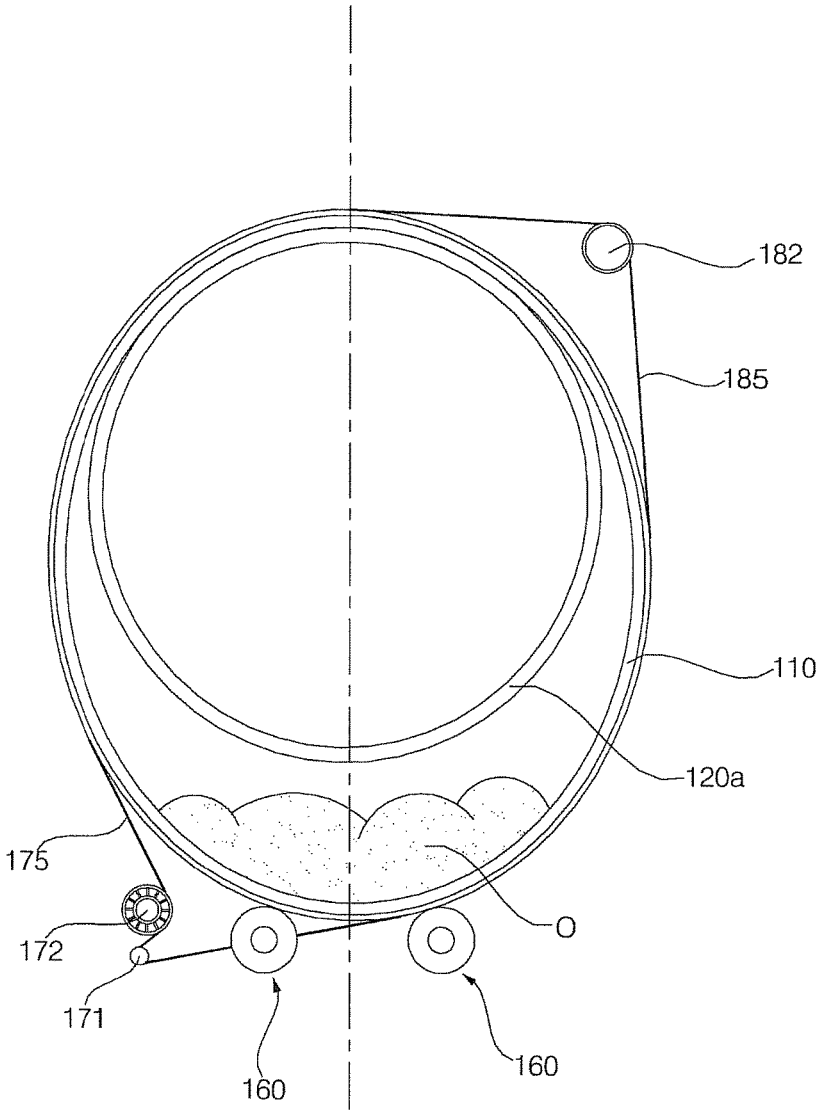
FIG. 15A is a front view illustrating the inside of a laundry treating apparatus according to another embodiment of the present invention.
Figure 15B:
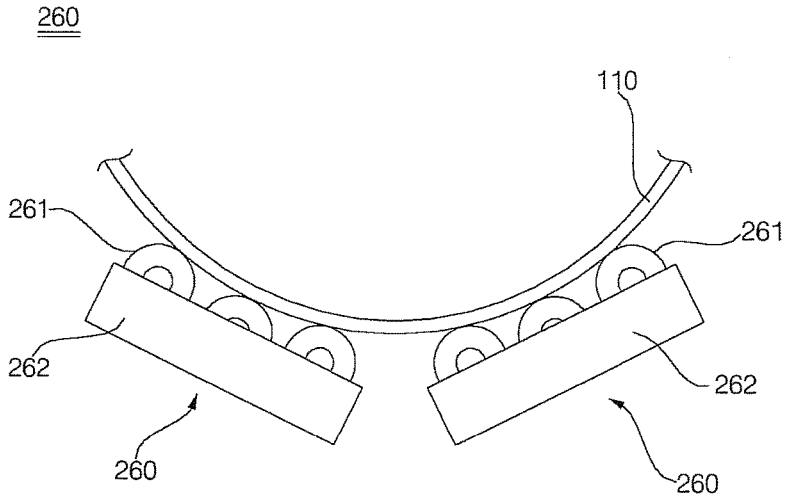
FIGS. 15B through 15D are views illustrating support members according to various embodiments of the present invention.
Figure 15C:
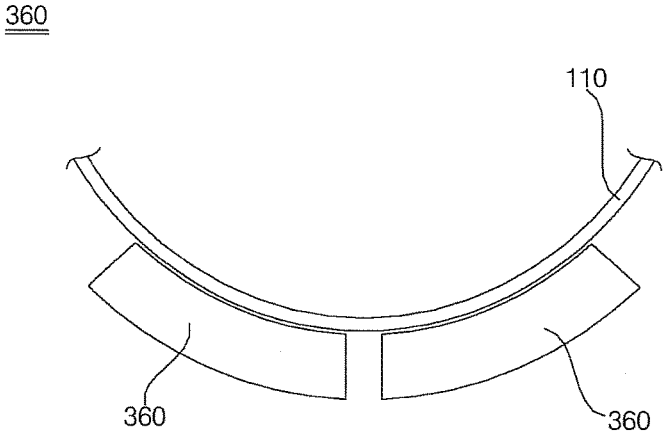
Figure 15D:
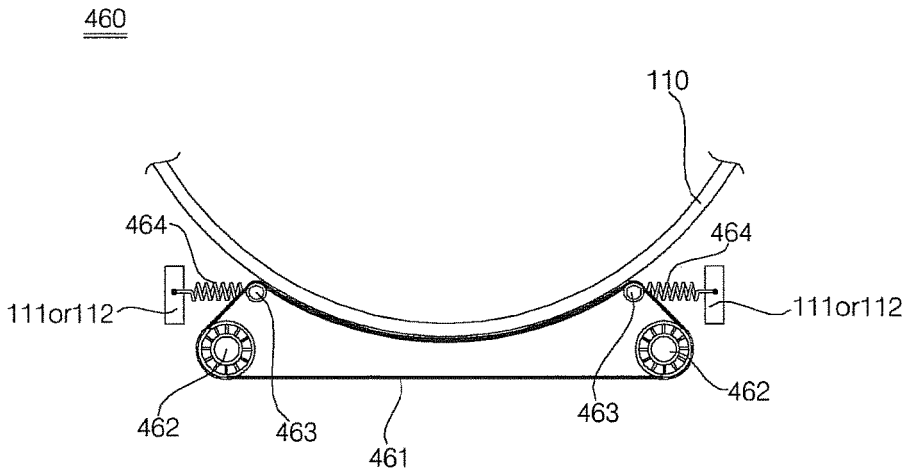

FIG. 15A is a front view illustrating the inside of a laundry treating apparatus according to another embodiment of the present invention. FIGS. 15B through 15D are views illustrating support members 160 according to various embodiments of the present invention.

Referring to FIGS. 15A through 15D, a laundry treating apparatus according to another embodiment of the present invention may include a drum 110 holding laundry, panels 111 and 112 provided on the front side and the rear side of the drum 110, and a support member 160 supporting the outer surface of the drum 110 and allowing the drum 110 to rotate while maintaining a cross-section of a noncircular looped curve. The front side and/or the rear side of the drum 110 may be opened, and the drum 110 may be rotatably disposed to have a cross-section of a noncircular looped curve in which a distance from the rotation center of the drum 110 is not uniform. Hereinafter, only parts other than parts described above will be described in detail, and unexplained reference numerals will be substituted with those described above.

The support member 160 may support the outer surface of the drum 110. The support member 160 may be provided outside the drum 110, and may be fixed provided on the cabinet 101 or the panels 111 and 112. The support member 160 provide outside the drum 110 may support the outer surface of the drum 110, and may maintain the shape of the drum 110.

Since the drum 110 rotates with a cross-section of a noncircular looped curve during the rotation of the drum 110, the shape of the drum may not be uniform. Also, the load of laundry O loaded in the drum 110 and the load of the drum 110 itself may be concentrated on the lower portion of the drum 110, and the concentrated portion may vary according to situations. In this case, the portion of the drum 110 on which the load of the drum 110 and laundry is concentrated may be further bent or have a greater curvature compared to other portions of the drum 110. This may cause a change of a noncircular looped curve that is initially set, and thus the sealing of the panel sealer 111-4 may be loosened or the rotation of the drum 110 may be interrupted.

Accordingly, in order to maintain the shape of the drum 110, the laundry treating apparatus may include the support member 160 that supports the outer surface of the drum 110. As described above, the support member 160 may allow the drum to rotate while maintaining an initial cross-section of a noncircular looped curve without any change of the shape of the drum 110 by the load of laundry O and the drum 110.

The support member 160 may prevent the drum 110 from sinking down due to the weight of the drum 110. The weight of the drum 110 and laundry O therein may sink the surface of the drum 110. Particularly, the lower portion of the drum may easily sink down. In this case, the support member 160 provided on the outer surface of the drum 110 may support the outer surface of the drum 110 and support the load of the drum 110 and laundry O therein to prevent the drum 110 from sinking down due to the weight of the drum 110. Since the support member 160 prevents the drum 110 from sinking down due to the weight of the drum 110 by supporting the outer surface of the drum 110, the drum 110 can rotate while maintaining the cross-sectional shape of a noncircular looped curve during the rotation of the drum 110.

As described above, the support member 160 may be provided in the cabinet 101 or the panels 111 and 112 of the laundry treating apparatus. Hereinafter, it will be described that the support member 160 is provided in the panels 111 and 112, but the fixed location of the support member 160 is not limited thereto. The support member 160 may be coupled to the panels 111 and 112, and the outer surface of the support member 160 may support the outer surface of the drum 110. In this case, when the drum 110 rotates, the outer surface of the drum 110 may rotate the support member 160, or may slide on the support member 160. The configuration in which the support member 160 slides on the outer surface of the drum 110 will be described later with reference to FIG. 15C. Hereinafter, it will be described that the support member 160 is rotatably provided in the panels 111 and 112 to allow the rotation of the drum 111 to rotate the support member 160.

As the support member 160 rotates due to the rotation of the outer surface of the drum 110, the shape of the drum 110 may be maintained, and simultaneously, the rotation of the drum 110 may not be interrupted to smoothen the operation of the drum 110.

The support member 160 may be provided in plurality. The support member 160 may be provided on each point that supports the outer surface of the drum 110. The plurality of support members 160 may be spaced from each other, and may support the outer surface of the drum 110 at each point. Since the plurality of support members 160 support the outer surface of the drum at multiple points, it becomes easy to maintain the shape of the drum 110 at the cross-section of the noncircular looped curve.

The support member 160 may be provided under the drum 110. Since laundry O is concentrated on the lower portion of the drum 110, the drum may easily sink down at the lower portion thereof. When the drum 110 sinks down, a portion where friction is concentrated between the drum 110 and the circular guides 120*a* and 120*b* may occur, and the portion may interrupt the rotation of the drum 110. Particularly, when the drum 110 sinks down, an extension may occur between both sides of the circular guides 120*a* and 120*b* and sides of the drum 110, and friction may be concentrated. The rotation of the drum 110 may be interrupted at a portion where friction is concentrated. In order to overcome such a limitation, the support member 160 may be provided under the drum 110 to maintain the shape of the drum 110.

The support member 160 may be provided at symmetrical locations under the drum 110 based on a line that vertically crosses the drum 110. The support member 160 may be symmetrically provided at both sides under the drum 110 based on the line that vertically crosses the cross-section of the drum 110. Ideally, since the load of the drum 110 and the load of laundry O are concentrated on the center of the bottom of the drum 110, when the support member 160 may be symmetrically provided at both sides under the drum 110 based on the center of the bottom of the drum 110 to optimally support the loads of the drum 110 and the laundry O.

The support member 160 may support the outer surface of the drum 110 so as to prevent sealing of the panel sealer 111-4 from being loosened during the rotation of the drum 110. As described above, the panel sealer 111-4 may be provided along the edge of the panels 111 and 112, and may seal a gap between the inner surface of the drum 110 and the circular guides 120*a* and 120*b*. In this case, since the panels 111 and 112 are formed according to the shape of the drum 110, the panel 111 and 112 may be formed with a shape corresponding to the cross-section of the noncircular looped curve that is the shape of the drum 110. Also, since the panel sealer 111-4 is formed along the edge of the panels 111 and 112, the panel sealer 111-4 may be formed according to the shape of the drum 110 that forms the cross-section of the noncircular looped curve.

In this case, when the drum 110 sinks down due to the weight thereof, a portion of the inner surface of the drum 110 that is in contact with the panel sealer 111-4 may be deformed into a different shape from the shape of the panels 111 and 112 due to the shape of the drum 111 that is deformed. Also, since the panel sealer 111-4 is formed according to the shape of the panels 111 and 112, the drum 110 that is deformed may have a shape different from the panel sealer 111-4, and the cross-sectional shapes may become different from each other. When the cross-sectional shapes of the panel sealer 111-4 and the drum become different, contact between the drum 110 and the panel sealer 111-4 may be released, and thus sealing therebetween may be released. Also, a portion where the panel sealer 111-4 is excessively compressed by the inner surface of the drum 110 may occur, and at the portion, friction between the drum 110 and the panel sealer 111-4 may increase more than is necessary, resulting in interruption of the rotation of the drum 110.

In order to overcome such a limitation, the drum 110 has to rotate while maintaining the initial cross-section of the noncircular looped curve. The support member 160 may maintain the sealing of the panel sealer 111-4 and the inner surface of the drum 110 and simultaneously smoothen the rotation of the drum, by supporting the outer surface of the drum 110 and allowing the drum 110 to maintain the initial cross-sectional shape of the noncircular looped curve.

The support member 160 may support a portion of the outer surface of the drum 110 that is not supported by the auxiliary guides 140*a* and 140*b*. As described above, the auxiliary guides 140*a* and 140*b* may support a portion that is not supported by the circular guides 120*a* and 120*b*. In this case, the auxiliary guides 140*a* and 140*b* may be disposed at a lower portion of the drum 110, and may support the inner surface of the drum 110 by providing a normal force facing from the inside to the outside of the drum 110 to the inner surface of the drum 110. In this case, the normal force applied at the lower portion of the drum 110 may be applied in the same direction as the gravitational direction by the load of the drum 110 and the laundry O. When the loads of the drum 110 and the laundry O and the force exerted by the auxiliary guides 140*a* and 140*b* are applied in the gravitational direction, the drum 110 may further sink down.

In this case, the support member 160 may prevent the drum 110 from sinking down due to the load of the drum 110 and the laundry O, by supporting a portion of the outer surface of the drum 110 that is not supported by the auxiliary guides 140*a* and 140*b*. When the support member 160 is provided on the undersurface of the drum 110, the direction of the force applied to the outer surface of the drum 110 by the support member 160 may become substantially opposite to the direction of the force applied to the inner surface of the drum 110 by the auxiliary guides 140*a* and 140*b*. Thus, since the support member 160 may provide a force in the opposite direction to the direction of the sinking of the drum 110, the drum 110 may be prevented from sinking down.

The support member 160 may support a portion of the outer surface of the drum 110 that is not in contact with the drive belt 175. As described above, the drive belt 175 may be rotated by the turning force of the motor 170, and may allow the drum 110 to rotate while maintaining the cross-section of the noncircular looped curve. The drive belt 175 that rotates the drum 110 may be partially spaced from the drum 110 due to the coupling relation of the motor 170 and the internal components. A portion of the drive belt 175 that is spaced from the drum 110 may vary according to the location of the motor 170. In the above-mentioned embodiment, the motor 170 may be provided under the drum 110, and a lower portion of the drum 110 may be spaced from the drive belt 175. The lower portion of the drum 110 that is not in contact with the drive belt 175 may sink down due to the load of the drum 110 and the laundry O.

In this case, the support member 160 may support the portion of the outer surface of the drum 110 that is not in contact with the drive belt 175. In the above-mentioned embodiment, the lower portion of the drum 110 may be spaced from the drive belt 175, and the outer surface of the lower portion of the drum 110 that is not in contact with the drive belt 175 may be supported by the support member 160 to prevent the drum 110 from sinking down and allow the drum 110 to rotate while maintaining the cross-section of the noncircular looped curve.

The support member 160 may support a portion of the drum 110 that is not supported by the circular guides 120*a* and 120*b*. The inner surface of the drum 110 that is supported by the circular guides 120*a* and 120*b* may correspond to the upper portion of the drum 110, and the lower portion of the drum 110 may not be supported by the circular guides 120*a* and 120*b*. Since the load of the drum 110 and the laundry O is concentrated on the lower portion of the drum 110 that is not supported by the circular guides 120*a* and 120*b*, the support member 160 may support the outer surface of the lower portion of the drum 110 to support the load of the drum 110 and the laundry O.

The support member 160 may be formed using the rotatable roller 160 that is shown in FIG. 15A. It will be described that the rotation axis of the roller 160 is fixed on the panels 111 and 112, but embodiments are not limited thereto. The outer surface of the roller 160 may support the outer surface of the drum 110 while the roller 160 rotates. When the drum 110 rotates, the outer surface of the drum 110 may allow the roller 160 to rotate on a fixed rotation axis, and the roller 160 may support the outer surface of the drum 110. The support member 160 formed using the roller 160 may support the outer surface of the drum 110 during the rotation of the drum 110, and simultaneously may be rotated by the outer surface of the drum 110.

The outer surface of the roller 160 may be formed of an elastic member of high hardness. When the outer surface of the roller 160 is formed of an elastic member of high hardness, a slip between the outer surface of the roller 160 and the outer surface of the drum 110 may not occur during the counter-rotation therebetween, and simultaneously, the vibration of the drum 110 may be absorbed to smoothen the rotation of the drum 110.

Referring to FIG. 15B, a support member 260 according to another embodiment may include a cluster housing 262 fixed on the panels 111 and 112 and having a roller receiving part recessed therein, and a plurality of cluster rollers 261 mounted in the roller receiving part and rotatably coupled to the cluster housing 262.

The cluster housing 262 may be fixed on the cabinet 101 and/or the panels 111 and 112. Hereinafter, it will be described that the cluster housing 262 is fixed on the panels 111 and 112, but the fixed location of the cluster housing 262 is not limited thereto. For example, the cluster housing 262 may also be fixed on the cabinet 101.

The cluster housing 262 may be recessed to form the roller receiving part. The cluster housing 262 may be provided in plurality under the drum 110, and may be symmetrically disposed at both sides under the drum 110.

The cluster roller 261 may be rotatably coupled to the roller receiving part. The cluster roller 261 may be provided in plurality in one roller receiving part. The rotation axes of the cluster rollers 261 may be coupled to the cluster housing 262 to allow the cluster rollers 261 to rotate.

The cluster roller 261 may support the outer surface of the drum 110. The outer surface of the cluster roller 261 may contact with the outer surface of the drum 110 to support the outer surface of the drum 110, and may support the load of the drum 110 and the laundry O to allow the drum 110 to rotate while maintaining a cross-section of a noncircular looped curve.

Referring to FIG. 15C, a support member 360 according to another embodiment may be formed using a sliding pad 360 that is curved. One surface of the curved center of the sliding pad 360 may be formed according to the outer surface of a noncircular looped curve to support the outer surface of the drum 110.

In this case, the outer surface of the drum 110 may slide on the sliding pad 360 during the rotation of the drum 110. When the outer surface of the drum 110 slides on the sliding pad 360, friction between the sliding pad 360 and the outer surface of the drum 110 may occur. In order to reduce such friction, the sliding pad 360 may be formed of a material having a low friction coefficient. The sliding pad 360 formed of a material having a low friction coefficient may support the load of the drum 110 and the laundry O during the rotation of the drum 110 to allow the drum 110 not to sink down and smoothen the rotation of the drum 110.

Referring to FIG. 15D, a support member 460 according to another embodiment may include a support belt 461 supporting the lower side of the drum 110 and rotated by the rotation of the drum 110, a main pulley 462 disposed inside the support belt 461 and supporting the support belt 461 such that the support belt 461 rotates, and an auxiliary pulley 463 disposed inside the support belt 461 and providing a tension to the support belt 461 such that the support belt 461 becomes tight.

The support belt 461 may contact with the undersurface of the drum 110 to support the lower side of the drum 110 and prevent the drum 110 from sinking down. The support belt 461 may be formed of a flexible and elastic highly-polymerized compound or metal material.

The main pulley 462 may be disposed inside the support belt 461 to provide a tension to the support belt 461. The main pulley 462 may be provided in plurality to support both sides of the support belt 461, and may be rotated by the motor 170 or a separate driving part to rotate the support belt 461. The rotation axis of the main pulley 462 may be provided in the panels 111 and 112 or the cabinet 101.

The auxiliary pulley 463 may be provided inside the support belt 461, and may be provided in plurality. The auxiliary pulley 463 may support the support belt 461 such that the support belt 461 contacts with the undersurface of the drum 110, and may pull the support belt 461 at both sides of the support belt 461 such that the support belt 461 becomes tight. The auxiliary pulley 463 may prevent the drum 110 from sinking down due to the load of the drum 110 and the laundry O, by supporting one side and the other side of the support belt 461 such that the support belt 461 corresponds to the shape of the outer surface of the drum 110 in contact therewith.

The support member 460 may further include a pulley tensioner 464. The pulley tensioner 464 may be coupled to the auxiliary pulley 463 at one side thereof, and may be fixed to the panels 111 and 112 at the other side thereof. The pulley tensioner 464 may be formed of an elastic material to provide an elastic force to the auxiliary pulley 463. The elastic force provided to the auxiliary pulley 463 may allow one auxiliary pulley 463 and the other auxiliary pulley 463 to become distant from each other in the opposite directions and thus allow the support belt 461 to become tighter between the one auxiliary pulley 463 and the other auxiliary pulley 463. Thus, the support belt 461 can firmly support the undersurface of the drum 110.

Figure 16A:
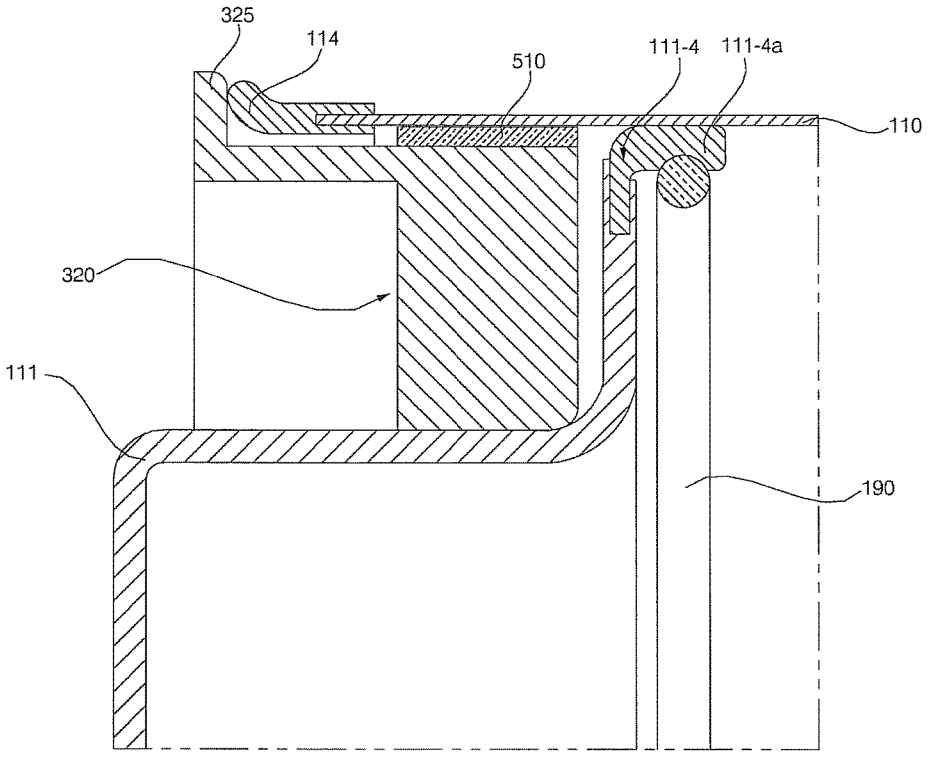
FIG. 16A is a view illustrating a configuration shown in FIG. 4B according to another embodiment of the present invention.
Figure 16B:
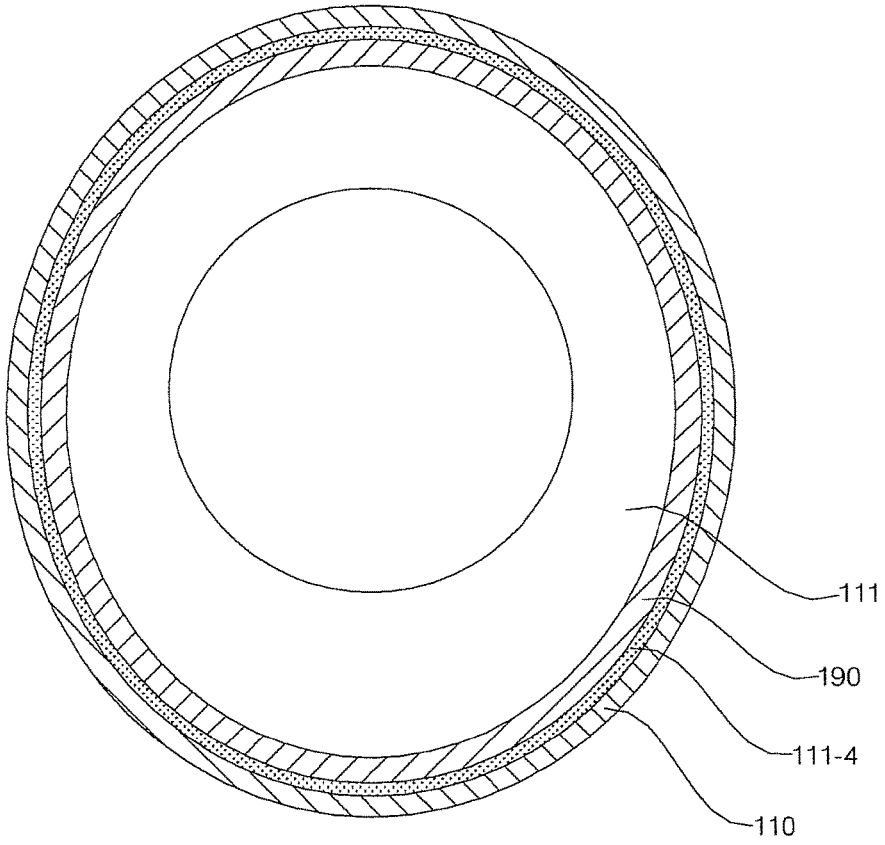
FIG. 16B is a front view of the configuration shown in FIG. 16A.

FIG. 16A is a view illustrating a configuration shown in FIG. 4B according to another embodiment of the present invention. FIG. 16B is a front view of the configuration shown in FIG. 16A.

Referring to FIGS. 16A through 16B, a laundry treating apparatus according to another embodiment of the present invention may include a drum 110 holding laundry, a panel 111 provided on the front side and the rear side of the drum 110, a panel sealer 111-4 provided on the panel 111 and having one surface thereof contacting the inner surface of the drum 110 to seal a gap between the drum 110 and the panel 111, and a panel sealer support member 190 provided inside the drum 110 and provided on the other surface of the panel sealer 111-4. The front side and/or the rear side of the drum 110 may be opened, and the drum 110 may be rotatably disposed to have a cross-section of a noncircular looped curve in which a distance from the rotation center of the drum 110 is not uniform. Hereinafter, only parts other than parts shown in FIG. 4B will be described in detail, and unexplained reference numerals will be substituted with those described in FIG. 4B.

The panel 111 denotes the front panel 111 or the rear panel 112. Hereinafter, the front panel 111 will be exemplified as the panel 111, but a description of the front panel 110 can also be applied to the rear panel 112.

The panel sealer 111-4 may be provided along the edge of the panel 111. The panel sealer 111-4 may have one side 111-4*a* contacting with the inner surface of the drum 110 and the other side fixedly provided on the panel 111. The one side 111-4*a* of the panel sealer 111-4 may be bent from the other side fixed on the panel 111 to contact with the inner surface of the drum 110. The diameter of the panel sealer 111-4 may be greater than the diameter of the inner surface of the drum 110. Accordingly, the one side 111-4*a* of the panel sealer 111-4 having a diameter greater than that of the inner surface of the drum 110 may be inserted into the inner surface of the drum 110.

One surface of the panel sealer 111-4 may contact with the inner surface of the drum 110 to seal a gap between the drum 110 and the panel 111. The one surface of the panel sealer 111-4 contacting with the drum 110, which is one surface of the one side 111-4*a* of the panel sealer 111-4, may contact with the inner surface of the drum to seal a gap between the inner surface of the drum 110 and the panel 111. Since drying efficiency is improved by sealing the inside of the drum 110 such that hot air is not leaked, the panel sealer 111-4 may seal a gap between the panel 111 and the inner surface of the drum 110. Accordingly, the panel sealer 111-4 may contact with the inner surface of the drum 110 to seal the inside of the drum 110.

The panel sealer 111-4 may be fixed on the panel 111 to slide on the inner surface of the drum 110 during the rotation of the drum 110. In this case, friction may occur between the panel sealer 111-4 and the inner surface of the drum 110. In order to reduce the friction, the panel sealer 111-4 may be formed of a material having a low friction coefficient, which may include a slidable member or a synthetic material mixed with polytetrafluoroethylene (PTFE) oil. The panel sealer 111-4 may include fabric, highly-polymerized compound, and rubber material of high hardness.

Contact between the panel sealer 111-4 and the inner surface of the drum 110 may be released at a portion by the variation of the shape of the drum 110 during the rotation of the drum 110. The drum 110 may rotate while maintaining the cross-section of the noncircular looped curve, but may vary in shape at a certain portion due to vibration generated in the drum 110 or the distribution of the load of the drum 110 and laundry. In this case, the shape of the drum 110 may be deformed from the initial cross-section of the noncircular looped curve to a deformed shape, and the contact between the inner surface of the drum 110 and the panel sealer 111-4 may be released or disconnected. When the inner surface of the drum 110 and the panel sealer 111-4 are spaced from each other, the sealing between the inner surface of the drum 110 and the panel sealer 111-4 may be released.

In order to maintain the sealing between the panel sealer 111-4 and the drum 110, the panel sealer support member 190 may be provided on the inner side of the drum 110. The panel sealer support member 190 may support the one side 111-4*a* of the panel sealer 111-4 that is bent inward, and may support the other surface of the one side 111-4*a* of the panel sealer 111-4 such that the one surface of the one side 111-4*a* of the panel sealer 111-4 contacts with the inner surface of the drum 110. The panel sealer support member 190 provided on the other surface of the one side 111-4*a* of the panel sealer 111-4 may compress the one side 111-4*a* of the panel sealer 111-4 toward the inner surface of the drum 110 such that the inner surface of the drum 110 contacts with the one surface of the one side 111-4*a* of the panel sealer 111-4.

Since the panel sealer support member 190 provided on the other surface of the panel sealer 111-4 applies a pressure to the other surface of the panel sealer 111-4 such that the one surface of the panel sealer 111-4 contacts with the inner surface of the drum 110, the sealing between the panel sealer 111-4 and the inner surface of the drum 110 can be maintained even when the cross-section shape of the drum 110 is deformed due to the vibration of the drum 110 or the load variation of the drum 110 during the rotation of the drum 110.

The panel sealer support member 190 may be formed of an elastic material. Since the panel sealer support member 190 may be formed of an elastic material that is slightly elastic in diameter, the panel sealer support member 190 may be inserted into the inner surface of the drum 110, and then elastically increase in diameter. The panel sealer support member 190 disposed inside the drum 110 may provide an elastic force to the one side 111-4*a* of the panel sealer 111-4 to maintain the one side 111-4*a* of the panel sealer 111-4 in contact with the inner surface of the drum 110 during the rotation of the drum 110.

The panel sealer support member 190 may be formed with a circular ring shape, and the section thereof may be circular. Also, the panel sealer support member 190 may be formed with a circular rim shape, and the section thereof may be rectangular. Hereinafter, it will be described that the section of the panel sealer support member 190 is a circular ring shape, but the shape of the panel sealer support member 190 is not limited thereto. The panel sealer support member 190 having a ring shape may be provided inside the drum 110 to support the other surface of the one side 111-4*a* of the panel sealer 111-4.

In this case, the one side 111-4*a* of the panel sealer 111-4 may be disposed between the panel sealer support member 190 and the inner surface of the drum 110. The panel sealer support member 190 may be disposed in the innermost diameter of the drum 110, and the one side 111-4*a* of the panel sealer 111-4 may be interposed between the drum 110 and the panel sealer support member 190. As described above, the panel sealer support member 190 may be slight elongated to apply a pressure to the other surface of the one side 111-4*a* of the panel sealer 111-4 and thus maintain the one surface of the one side 111-4*a* of the panel sealer 111-4 in contact with the inner surface of the drum 110.

The pad 510 may be provided between the drum 110 and the circular guide 320. The pad 510 may be fixedly provided on the inner surface of the drum 110 along the edge of the drum 110. Also, the pad 510 may be fixedly provided along the outer surface of the circular guide 320. Hereinafter, it will be described that the pad 510 is fixedly provided along the inner surface of the drum, but embodiments are not limited thereto. For example, the pad 510 may be fixed on the circular guide 320, or may be neither fixed on the circular guide 320 nor the inner surface of the drum 110.

The pad 510 may rotate together with the drum 110 during the rotation of the drum 110. When the drum 110 rotates, the pad 510 provided between the drum 110 and the circular guide 320 may rotate together with the drum 110. In this case, the pad 510 may rotate at the same angular speed as the drum 110, or may rotate while causing a slip with the drum 110. Also, even when the circular guide 320 rotate due to the rotation of the drum 110, the pad 510 may rotate together with the drum 110 and/or the circular guide 320.

The pad 510 may reduce noise generated by friction between the circular guide 320 and the drum 110. When there are a friction between the drum 110 and the circular guide 320 and a slip between the drum 110 and the circular guide 320, noise may be generated due to the friction between the drum 110 and the circular guide 320. In this case, the pad 510 may be provided between the drum 110 and the circular guide 320 to absorb noise generated between the drum 110 and the circular guide 320.

Also, mechanical vibration may occur due to the friction between the circular guide 320 and the drum 110. In turn, the vibration may vibrate the surface of the drum 110, and may interrupt the rotation of the drum 110 and generate noise due to the mechanical vibration on the surface of the drum 110. In this case, since the pad 510 is provided between the drum 110 and the circular guide 320, the vibration generated between the drum 110 and the circular guide 320 can be absorbed.

When the pad 510 is fixed on the circular guide 320, a slip may occur between the inner surface of the drum 110 and the pad 510. Also, when the pad 510 is fixed on the inner surface of the drum 110, a slip may occur between the circular guide 320 and the pad 510. Also, when the pad is provided but not fixed between the circular guide 320 and the drum 110, a slip may occur between the drum 110 and the pad 510 and between the circular guide 320 and the pad 510. Hereinafter, it will be described that the pad 510 is fixedly provided on the inner surface of the drum 110 and a slip occurs between the pad 510 and the circular guide 320, but embodiments are not limited thereto.

The pad 510 may be formed of a material having a high friction coefficient such that a slip does not occur between the pad 510 and the circular guide 320. The pad 510 may be formed of a fabric material having a high friction coefficient, or may be formed of a silicone material having a high friction coefficient. Also, the pad 510 may include a typical rubber material. Hereinafter, it will be described that the pad 510 is formed of a rubber material, but embodiments are not limited thereto. Since the pad 510 is formed of a material having a high friction coefficient, a slip may be prevented from occurring between the pad 510 and the drum 110 or the circular guide 320.

The pad 510 may be formed of an elastic material. A portion of the load of the drum 110 may be delivered to the pad 510 during the rotation of the drum 110, and thus the pad 510 may be compressed between the drum 110 and the circular guide 320 by the load of the drum 110. In this case, since the pad 510 is formed of an elastic material, and may be compressed between the circular guide 320 and the drum 110 by the load of the drum 110, the pad 510 can seal a gap between the drum 110 and the circular guides 120*a* and the 120*b*.

Unlike the embodiment of FIG. 4B, a drum protector 325 may be formed on one side of the circular guide 320 to cover the edge of the drum 110. The drum protector 325 may extend from one side of the circular guide 320. The drum protector 325 may be formed integrally with the circular guide 320, and may be bent to cover the edge of the drum 110. Since the drum protector 325 may be formed to have a diameter greater than the edge of the drum 110, the drum protector 325 may project upward compared to the edge of the drum 110.

The drum protector 325 formed integrally with the circular guide 320 may prevent the drum 110 from being separated from the circular guide 320 in the forward or backward direction due to vibration generated during the rotation of the drum, by covering and supporting the edge of the drum 110.

Hereinafter, an operation of a laundry treating apparatus according to an embodiment will be described.

If a user loads laundry into the drum 110 and then operates the laundry treating apparatus, air heated by the heater 130 may flow into the drum 110, and the drum 110 may rotate.

Air heated by the heater 130 may flow into the drum 110 through the intake duct 135 at the side of the rear panel 112. The front side and the rear side of the drum 110 may be sealed by the front panel 111 and the front panel 112, respectively. The drum may be primarily sealed in contact with the panel sealer 111-4, and then secondarily sealed by the drum sealer 114 in contact with the circular guide bracket 121 to interrupt leakage of air from the drum 110. Although the primary sealing and the secondary sealing are released due to excessive vibration of the drum 110, the drum 110 may be tertiarily sealed by the drum sealer 114 in contact with the front panel protector 111-1. Air inside the drum 110 may be exhausted into the exhaust duct 133 by the air blower 131, and air exhausted into the exhaust duct 133 may be discharged to the outside or recycled into the heater 130.

On the other hand, when the motor 170 generates a turning force, the drive belt 175 may rotate the drum 110. As the drum 110 rotates, the front circular guide 120*a* and the rear circular guide 120*b* may together rotate. Thus, a portion of the drum 110 where the curvature is uniform may be supported by the circular guides 120*a* and 120*b*. Since a portion of the drum 110 that is not supported by the circular guides 120*a* and 120*b* is supported by the auxiliary guides 140*a* and 140*b*, the drum 110 may rotate while maintaining a cross-section of a noncircular looped curve. The circular guides 120*a* and 120*b* and the auxiliary guides 140*a* and 140*b* support the drum 110 by contacting the inner surface of the drum 110 to apply a normal force to the drum 110 in an outward direction, whereas the drive belt 175 and the auxiliary belt 185 may support the drum 110 by contacting the outer surface of the drum 110 to apply a normal force to the drum 110 in an inward direction. The auxiliary belt 185 may prevent the drum 110 from leaning by contacting a portion of the drum 110 with which the drive belt 175 does not contact.

While the drum 110 is rotating and laundry is being tumbled by the lifter 115, laundry may be dried by heated air.

A dryer has been described as an example of a laundry treating apparatus, and the spirit of the present invention can be applied to various laundry treating apparatuses such as washing machines including a drum.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet;

a drum rotatably disposed in the cabinet to hold laundry, the drum having a cross-section including at least one first portion having a uniform curvature and at least one second portion having a non-uniform curvature;

a first circular guide coupled to the cabinet and supporting the at least one first portion of the drum; and at least one rolling device rotatably provided in the cabinet to support the first circular guide, wherein the first circular guide has a ring shape, wherein a portion of an outer surface of the first circular guide contacts an inner surface of a front or a rear of the at least one first portion of the drum, wherein a portion of an inner surface of the first circular guide contacts the at least one rolling device, and wherein an inner surface of a front or rear of the at least one second portion of the drum does not contact the at least one circular guide.

2. The laundry treating apparatus of claim 1, wherein the first circular guide has an annular shape and is rotatably provided in the cabinet.

3. The laundry treating apparatus of claim 1, wherein the first circular guide supports a load of the drum and rotates together with the drum.

4. The laundry treating apparatus of claim 1, further comprising a circular guide supporter coupled to the cabinet and rotatably supporting the first circular guide.

5. The laundry treating apparatus of claim 4, wherein the circular guide supporter comprises a panel provided at a front of the drum or a rear of the drum that is fixed to the cabinet such that the first circular guide rotates with respect to the panel.

6. The laundry treating apparatus of claim 4, wherein the circular guide supporter is disposed at an interior side of a front wall of the cabinet or at an interior side of a rear wall of the cabinet.

7. The laundry treating apparatus of claim 4, wherein the at least one rolling device is provided between the first circular guide and the circular guide supporter.

8. The laundry treating apparatus of claim 7, wherein the at least one rolling device comprises: a shaft fixed to the circular guide supporter; and a rotation member installed on the shaft and counter-rotating with respect to the first circular guide.

9. The laundry treating apparatus of claim 7, wherein the at least one rolling device comprises a plurality of rolling devices coupled to the circular guide supporter.

10. The laundry treating apparatus of claim 9, wherein the plurality of rolling devices comprises at least two rolling devices provided on an upper portion of the circular guide supporter.

11. The laundry treating apparatus of claim 9, wherein a load of the first circular guide is concentrated on two of the plurality of rolling devices provided on an upper portion of the circular guide supporter.

12. The laundry treating apparatus of claim 1, wherein a rotational center of the drum is located within a boundary defined by the first circular guide.

13. The laundry treating apparatus of claim 1, further comprising a second circular guide supporting another first portion of the drum that is not supported by the first circular guide, the another first portion of the drum having a uniform cross-section.

14. The laundry treating apparatus of claim 13, wherein the first and second circular guides partially overlap each other.

15. The laundry treating apparatus of claim 14, wherein respective centers of the first and second circular guides are offset from a rotation axis of the drum.

16. The laundry treating apparatus of claim 13, wherein a rotation center of the first circular guide is positioned vertically above a rotation center of a drum, and a rotation center of the second circular guide is positioned vertically below the rotation center of the drum.

17. The laundry treating apparatus of claim 13, wherein the first circular guide supports an upper portion of the drum, and the second circular guide supports a lower portion of the drum.

18. The laundry treating apparatus of claim 13, wherein a remaining portion of the drum that is not supported by the first and second circular guides has a non-uniform curvature.

19. The laundry treating apparatus of claim 1, further comprising an auxiliary guide to support a portion of the drum that is not supported by the first circular guide, and to maintain the non-uniform curvature cross-section of the drum as the drum rotates.

* * * * *